US007963857B1

(12) United States Patent
Kachlik

(10) Patent No.: US 7,963,857 B1
(45) Date of Patent: Jun. 21, 2011

(54) INCREASED DIAMETER ARTHRITIC GOLF CLUB GRIPS

(76) Inventor: Michael R. Kachlik, Warsaw, IN (US)

( * ) Notice: Subject to any disclaimer, the term of this patent is extended or adjusted under 35 U.S.C. 154(b) by 246 days.

(21) Appl. No.: 12/433,005

(22) Filed: Apr. 30, 2009

Related U.S. Application Data

(60) Provisional application No. 61/049,840, filed on May 2, 2008.

(51) Int. Cl.
*A63B 49/08* (2006.01)

(52) U.S. Cl. ..... 473/300; 473/301; 473/303

(58) Field of Classification Search ..... 473/300, 473/301
See application file for complete search history.

(56) References Cited

U.S. PATENT DOCUMENTS

| | | | | |
|---|---|---|---|---|
| 4,065,127 | A | 12/1977 | Fagan | |
| 4,597,578 | A * | 7/1986 | Lancaster | 473/300 |
| 5,427,376 | A | 6/1995 | Cummings et al. | |
| 5,588,921 | A | 12/1996 | Parsick | |
| 5,634,859 | A * | 6/1997 | Nesbitt | 473/301 |
| 5,681,226 | A | 10/1997 | Chambers, Jr. | |
| 5,749,792 | A * | 5/1998 | Engfer et al. | 473/300 |
| 5,842,930 | A | 12/1998 | Koterba | |
| 5,851,156 | A | 12/1998 | Schwark, Jr. | |
| 6,352,481 | B1 | 3/2002 | Pak | |
| 6,386,989 | B1 | 5/2002 | Huang | |
| 6,540,621 | B1 | 4/2003 | Robinson | |
| 6,551,198 | B2 | 4/2003 | Huang | |
| 6,663,500 | B2 | 12/2003 | Huang | |
| 6,695,713 | B2 | 2/2004 | Huang | |
| 6,709,346 | B1 | 3/2004 | Wang | |
| 7,374,498 | B2 | 5/2008 | Huang | |
| 2002/0061787 | A1 | 5/2002 | Huang | |
| 2003/0027656 | A1 | 2/2003 | Katsuya | |
| 2003/0162604 | A1 | 8/2003 | Matsumoto | |
| 2008/0283178 | A1 | 11/2008 | Huang | |

* cited by examiner

*Primary Examiner* — Gene Kim
*Assistant Examiner* — Michael D Dennis
(74) *Attorney, Agent, or Firm* — Baker & Daniels LLP

(57) ABSTRACT

A golf club grip system having grips that have grip diameters ranging from 1.0 inches (25.4 mm) to 1.2 inches (30.5 mm). Additionally, each golf club grip may include an outer wrap and an inner layer. The outer wrap is substantially thinner than the inner layer and consists predominantly of polyurethane and felt. Specifically, in one exemplary embodiment, the outer wrap consists of two separate layers of polyurethane, a layer of felt, and two thin strips of adhesive tape. By utilizing these materials, the outer wrap provides a high traction, i.e., slip resistant, surface with improved shock and vibration dampening characteristics. Additionally, by utilizing the combination of the outer wrap and the inner layer, the grip provides shock absorption with substantially increased resistant to torsional forces.

18 Claims, 33 Drawing Sheets

INCREASED DIAMETER ARTHRITIC GOLF CLUB GRIPS

CROSS-REFERENCE TO RELATED APPLICATIONS

This application claims the benefit under Title 35, U.S.C. §119(e) of U.S. Provisional Patent Application Ser. No. 61/049,840, entitled INCREASED DIAMETER ARTHRITIC GOLF CLUB GRIPS, filed on May 2, 2008, the disclosure of which is expressly incorporated by reference herein.

BACKGROUND

1. Field of the Invention

The present invention relates to golf clubs and, particularly, to golf grips for use in conjunction with golf clubs.

2. Description of the Related Art

In a normal, healthy hand, each of the finger joints of the hand are capable of flexing approximately 90 degrees relative to one another to allow the hand and the corresponding fingers to wrap around an object. Additionally, this allows for the hand to exert substantial compressive forces against the object to grasp and move the same. As a result, a person having normal, healthy hands is capable of efficiently grasping standard diameter golf club grips in order to swing a golf club.

However, when a person develops osteoarthritis in the hands and/or fingers, osteoarthritic changes of the finger joints may occur and inflammation and pain in the finger joints may result. This may lead to swelling and the formation of heterotopic bone within the finger joints, which may result in the joints of the fingers having a reduced range of motion. For example, in some people, the reduction in range of motion may be ten to fifty percent of the range of motion of a normal, healthy hand. This reduces the ability of the individual to wrap their hand around an object having a small diameter, such as a golf club grip, and to exert a substantial compressive force on the same. Moreover, due to the inflammation and pain in the joint caused by the osteoarthritis, the individual may opt to utilize their hands to grasp objects less frequently, causing atrophy of the muscles that further reduces the grasping strength of the individual.

While golf club grips having slightly larger diameters than a standard grip have been introduced for arthritic golfers, the increased diameter of these grips results in the golfer using a grip that has a diameter that is larger than the ideal golf club grip diameter for the individual. As a result, the individual is hampered in his or her ability to achieve the desired combination of maximum club head impact speed and optimal club head rotation rate through the hitting area. Specifically, arthritic golf club grips are made of substantially softer materials than are utilized in standard grips to allow the arthritic grip to more effectively absorb shock and vibration generated during ball striking and, correspondingly, reduce the pain and/or discomfort that a golfer may experience when hitting a golf ball. However, the use of softer materials in the construction of an arthritic golf club grip results in the grip experiencing greater torsion, i.e., being less resistant to rotational forces, during a golf swing. This results in the arthritic golf club grip experiencing excessive twisting between the golfer's hands and shaft of the golf club during a golf swing, which may cause a loss of directional control during the golf shot.

In addition to the problems identified above, arthritic golf club grips are also intended to be used in conjunction with traditional methods of swinging and gripping a golf club, such as the Vardon gripping method. Utilizing the Vardon gripping method, as shown generally in FIGS. 1-3, upper hand 10 is wrapped around grip 12 of golf shaft 14 with thumb 16 of upper hand 10 placed so as to rest on top portion 18 of grip 12. As shown in FIG. 2, lower hand 20 is then wrapped around grip 12 in a manner in which it encompasses thumb 16 of upper hand 10, as well as grip 12. Currently, there are three traditionally accepted gripping methods and all three gripping methods require thumb 16 of upper hand 10 to be positioned on top portion 18 of grip 12 with lower hand 20 encompassing both thumb 16 and grip 12. Specifically, the Vardon over-lapping technique, shown in FIGS. 1-4, requires pinky finger 22 (FIG. 4) of lower hand 20 to rest on top of index finger 24 (FIG. 4) of upper hand 10. The Interlocking technique, shown in FIG. 5, requires that pinky finger 22 of lower hand 20 is positioned between index finger 24 and pointer finger 26 of upper hand 10. The Ten-Finger technique, shown in FIG. 6, requires pinky finger 22 of lower hand 20 to wrap directly onto grip 12 so that the lateral aspect of pinky finger 22 of lower hand 20 rests against the medial aspect of pointer finger 26 of upper hand 10.

Currently, these three gripping methods are the industry standard for hand placement on a golf club. In fact, the use of standard size golf club grips in conjunction with the use of these three methods for gripping the golf grip has performed extremely well for professional and low handicapped golfers. However, for the remaining majority of golfers, including arthritic golfers, this combination of grip size and gripping technique has performed poorly and has led to a great deal of frustration.

SUMMARY

In one exemplary embodiment, the present invention provides a golf club grip system having grips that have grip diameters ranging from 1.0 inches to 1.2 inches. Each of the grips have a substantially cylindrical body that defines an open end for receipt of a golf club shaft, a closed or cap end, and a gripping surface. Additionally, each grip may include an inner layer, which defines a substantially cylindrical body that has an open end for receipt of a golf club shaft and a closed or cap end, and an outer wrap, which defines a gripping surface and surrounds at least a portion of the inner layer. In one exemplary embodiment, the outer wrap is spiral wrapped around the inner layer in a known manner to form the golf club grip. The outer wrap is substantially thinner than the inner layer and consists predominantly of polyurethane and a natural fiber felt layer. Specifically, in one exemplary embodiment, the outer wrap consists of two separate layers of polyurethane, a layer of felt, and two thin adhesive layers. By utilizing these materials, the outer wrap provides a high traction, i.e., slip resistant, surface with improved shock and vibration dampening characteristics.

As indicated above, to form a completed golf club grip, the outer wrap is secured to a thicker inner layer by spiral wrapping the outer warp around the inner layer in a known manner. In one exemplary embodiment, the thicker inner layer consists of a dense, torsion resistant synthetic rubber. Advantageously, the inner layer utilizes materials that provide a torsion resistant foundation for the outer wrap that minimizes the torsion between the shaft of the golf club and the golfer's hand when the golf club is in use.

By utilizing the oversized grip system of the present invention, arthritic golfers, with their associated reduced finger flexion and strength can comfortably grasp the larger diameter grips and swing the golf club without any reduction of the maximum club head velocity or club head rotational rate. As a result, this grip system provides equal or superior protection from shock and vibration without the undesirable increase in grip torsion of previous arthritic golf grips.

In another exemplary embodiment, the present invention provides a golf club gripping method that allows a golfer to easily convert from the standard gripping method used with standard sized golf grips to the new gripping method used with oversized diameter golf grips made in accordance with the present invention. Advantageously, the use of the golf club grip method of the present invention in conjunction with oversized grips provides an arthritic golfer with a golf grip that is capable of substantially improving their ability to hit a golf ball, resulting in an improved golf game.

In one form thereof, the present invention provides a golf club grip system, including a golf club grip having an inner layer and an outer wrap. The inner layer is formed as a substantially cylindrical body having an open end for receipt of a golf club shaft and a cap end. The outer wrap surrounds at least a portion of the inner layer and defines a gripping surface. The golf club grip has a grip diameter prior to installation on a golf club shaft that is defined by the gripping surface and has a grip wall thickness extending radially from an inner surface of the inner layer to the gripping surface. Both of the grip diameter and the grip wall thickness are measured at a point about 158 millimeters from a proximal end of each of the plurality of golf club grips defined by the cap end of each of the plurality of golf club grips, with the grip diameter being at least 25.4 millimeters and no more than 30.5 millimeters. Additionally, the golf club grip has a degree of torsion of at least 5 degrees and no more than 20 degrees, an elastic deformation under 5 pounds of vertical compressive force of at least 1.0 millimeters and no more than 2.0 millimeters, and an elastic deformation under 15 pounds of vertical compressive force of at least 1.5 millimeters and no more than 3.0 millimeters.

In another form thereof, the present invention provides a golf club grip system, including a plurality of golf club grips, each of the plurality of golf club grips including an inner layer forming a substantially cylindrical body having an open end for receipt of a golf club shaft and a cap end. The inner layer also has an inner layer thickness measured prior to installation on a golf club shaft. The outer wrap surrounds at least a portion of the inner layer and defines a gripping surface. The outer wrap also has an outer wrap thickness measured prior to installation on a golf club shaft. The outer wrap includes a first polymer layer secured to a first side of a felt layer, a first adhesive positioned on a second side of the felt layer, and a second polymer layer secured to the second side of the felt layer by the adhesive, with the inner layer thickness being at least 2.3 times greater than the outer wrap thickness and no more than 3.1 times greater than the outer wrap thickness when measured at a distance of about 158 millimeters from a proximal end of each of the plurality of golf club grips defined by the cap end of each of the plurality of golf club grips.

In yet another form thereof, the present invention provides a golf club grip system, including a plurality of golf club grips, with each of the plurality of golf club grips having an inner layer and an outer wrap. The inner layer forms a substantially cylindrical body having an open end for receipt of a golf club shaft and a cap end. The outer wrap surrounds at least a portion of the inner layer and defines a gripping surface, with each of the plurality of golf club grips having a grip diameter prior to installation on a golf club shaft defined by the gripping surface and a grip wall thickness extending radially from an inner surface of the inner layer to the gripping surface. Both of the grip diameter and the grip wall thickness are measured at a distance of about 158 millimeters from a proximal end of each of the plurality of golf club grips defined by the cap end of each of the plurality of golf club grips. The grip diameter being at least 3.8 times greater than the grip wall thickness and no more than 4.7 times greater than the grip wall thickness.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention and such exemplifications are not to be construed as limiting the scope of the invention in any manner.

DETAILED DESCRIPTION

Figure 1:
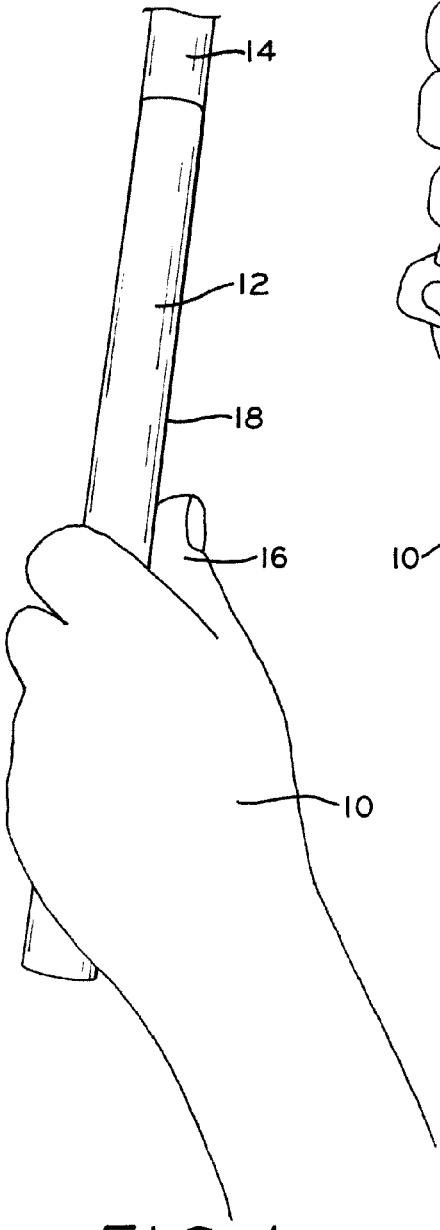
FIG. 1 PRIOR ART
FIG. 1 is a perspective view of an upper hand positioned on a golf grip in accordance with the Vardon gripping method, the Interlocking gripping method, and the Ten-Finger gripping method.
Figure 2:
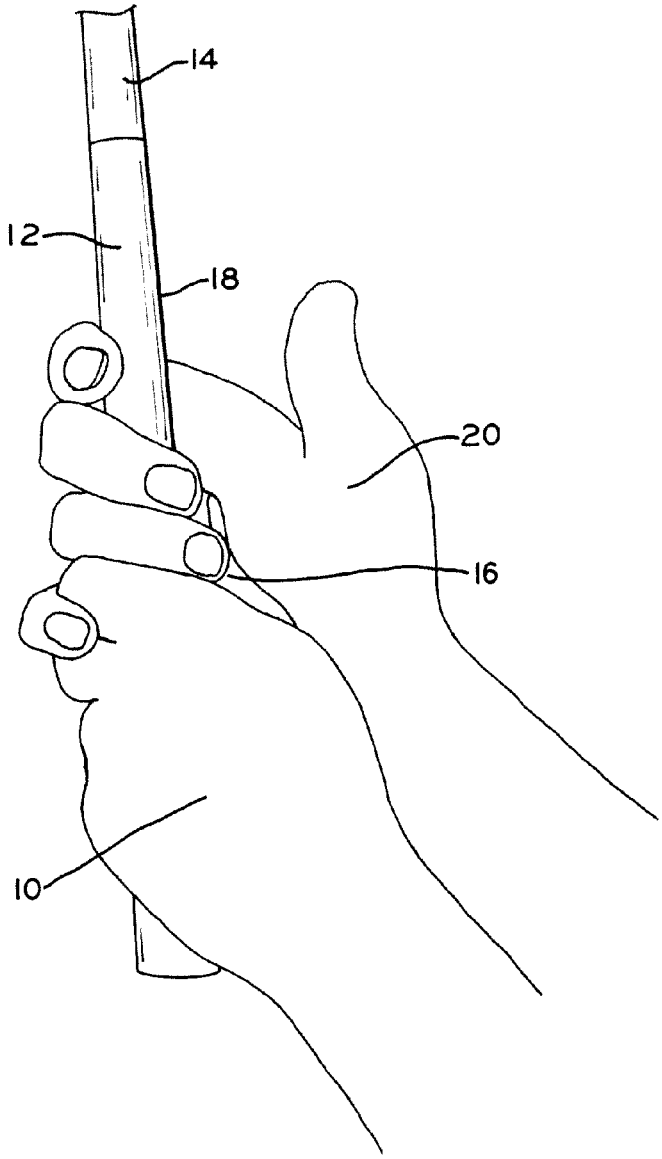
FIG. 2 PRIOR ART
FIG. 2 is a perspective view of a pair of hands positioned on a golf grip in accordance with the Vardon gripping method.
Figure 3:
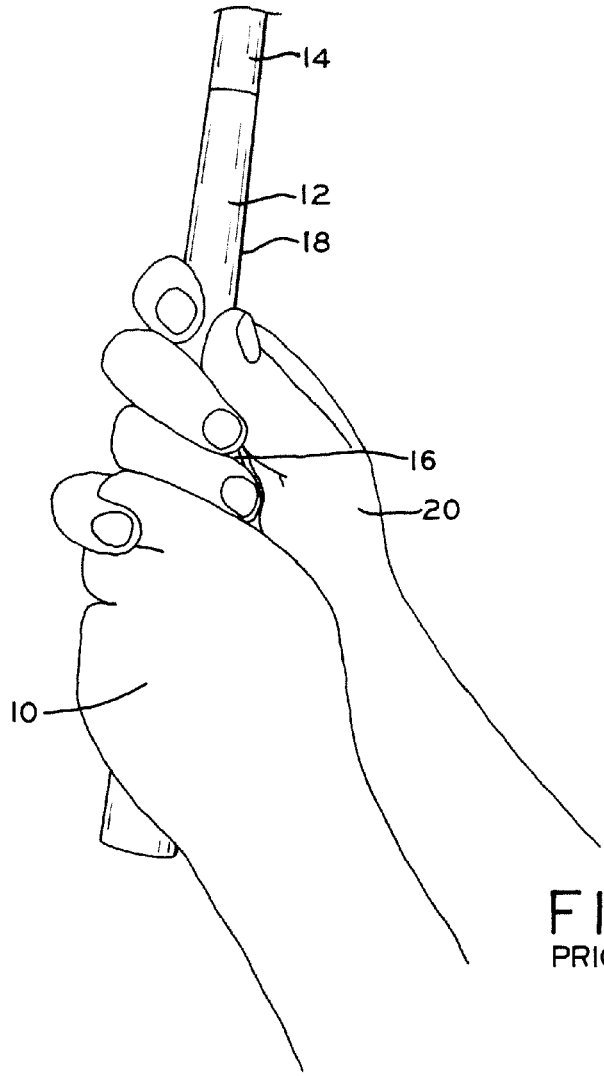
FIG. 3 PRIOR ART
FIG. 3 is another perspective view of the pair of hands of FIG. 2 positioned on a golf grip in accordance with the Vardon gripping method.
Figure 4:
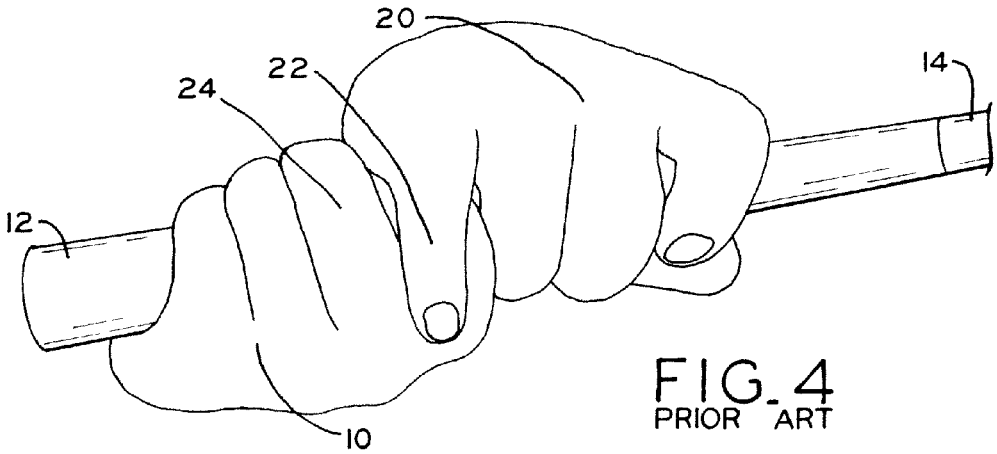
FIG. 4 PRIOR ART
FIG. 4 is a perspective view of a pair of hands positioned on a golf grip in accordance with the Vardon gripping method.
Figure 5:
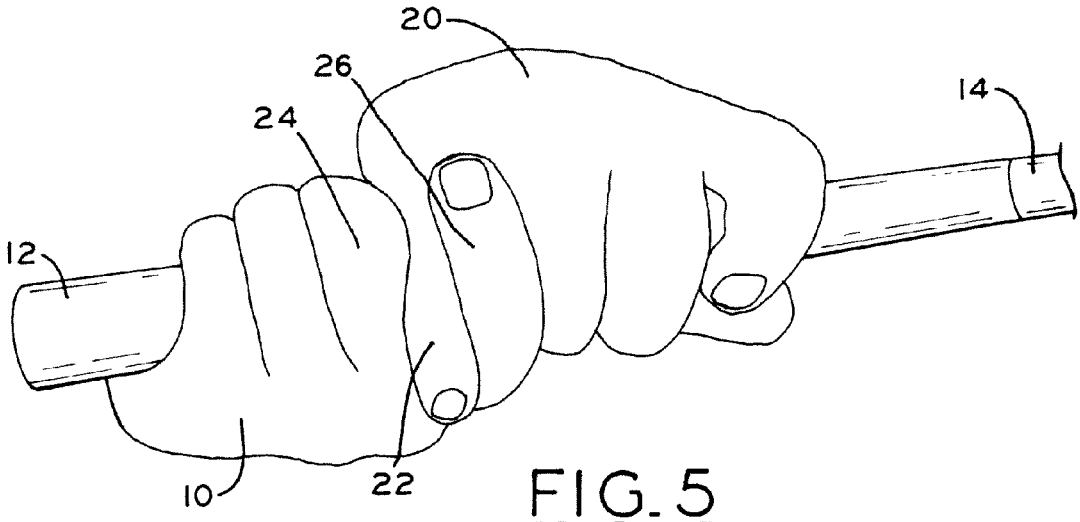
FIG. 5 PRIOR ART
FIG. 5 is a perspective view of a pair of hands positioned on a golf grip in accordance with the Interlocking gripping method.
Figure 6:
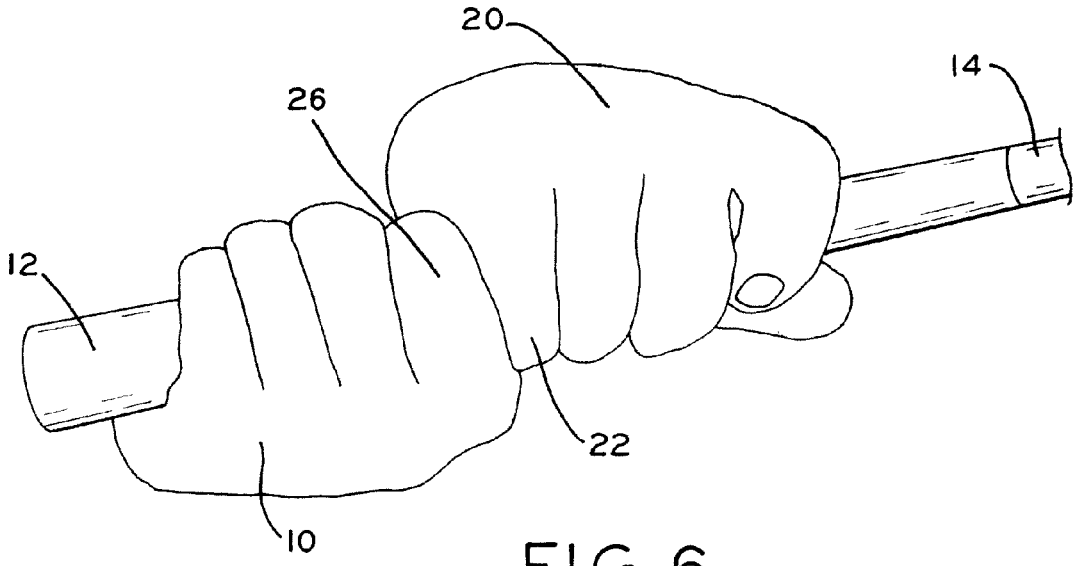
FIG. 6 PRIOR ART
FIG. 6 is a perspective view of a pair of hands positioned on a golf grip in accordance with the Ten-Finger gripping method.

The present golf club grip system allows golfers to consistently rotate the head of a golf club during the golf swing at the desired rate and has characteristics sufficient for use with an arthritic hand. For example, in order for the grip to be beneficial for an arthritic golfer, the grip diameter must he large enough to allow the arthritic hand to adequately grasp and hold the golf club during a swinging action, while the circumference of the grip remains small enough that the golfer can adequately wrap their fingers around the grip to secure the golf club during the swinging action. Absent an indication to the contrary, as used herein, "grip diameter" and "total grip diameter" refer to the diameter of a cross-section of a golf club grip measured at a distance of about 158 mm from the proximal end of the golf grip defined by cap end 11, shown in FIG. 16. While cap end 11 is described and depicted herein as being an integral component of inner layer 110, described below, cap end 11 may be a separate component that is secured to the inner layer during manufacture, a series of additional components that cooperate to define cap end 11, or cap end 11 may secured to a different portion of the golf club grip. However, regardless of its configuration, cap end 11 defines the proximal end of the grip, i.e., the end of the grip that is opposite the club head and closest to the golfer.

Additionally, depending on the context in which the phrase "grip diameter" or "total grip diameter" is used, it may refer to the diameter of a cross-section of the golf grip taken perpendicular to the longitudinal axis of the grip and measured at a distance of about 158 mm from the proximal end of the grip defined by cap end 11 either before or after the grip has been installed onto a standard golf club shaft having a golf shaft diameter of substantially 0.60 inches. Similarly, absent an indication to the contrary, as used herein, "golf shaft diameter" is the cross-sectional diameter of a golf club shaft taken in a plane transverse to the longitudinal axis of the golf club shaft and at a distance of about 158 mm from the proximal end, i.e., the end opposite the club head and closest to the golfer, of the golf shaft.

In making a golf shot, it is desirable to achieve the optimal club head rotation rate during rotational acceleration of the golf club, i.e., the rotation rate that allows the golfer to accelerate the club head to the maximum impact velocity that will still allow the golfer to maintain excellent control of the club head impact position and will provide the golfer with the maximum amount of golf shot directional control. The total club head velocity that is imparted to a golf ball is the sum of the linear acceleration of the club head that is achieved by straightening the angle formed by the golf club shaft and the leading arm of the golfer and the rotational acceleration of the club head along a circular arc in the direction of the target. Specifically, during a golf shot, the head of the golf club is rotated through an approximate 30 degree arc from 6 inches before impact to 6 inches after impact. i.e., the impact area. This arc of motion equates to an average club head rotation rate of 2.5 degrees per inch as the club head travels through the impact area. The club head rotation rate through the impact area of 2.5 degrees per inch is considered to be the optimal club head rotation rate and has been measured and confirmed by careful analysis of the golf swing of many of the top professional golfers of the world. In contrast, if the golf head is rotated too slowly or too quickly through the impact area, the club face will contact the ball in an open position, i.e., an under-rotated position, or a closed position, i.e., an over-rotated position, respectively, and will launch the ball in a direction that is off the intended target line with an excess of side spin being transferred to the ball.

Figure 7:
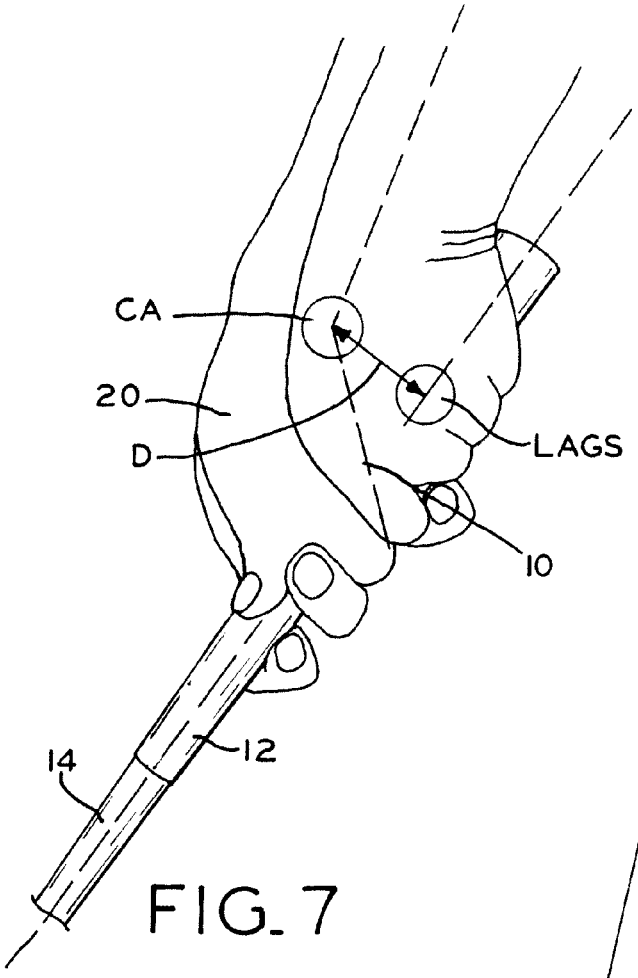
FIG. 7 is a perspective view of a pair of hands positioned on a golf grip in accordance with the Vardon gripping method.

In order to consistently achieve the desired club head rotation rate, it may be desirable to maintain a proper distance between the axis of the golf shaft and the central axis of the wrist of the golfer's lower hand. Specifically, referring to FIG. 7, with lower hand 20 of the golfer resting on golf grip 12, the lower hand must be rotated in the direction of the target during the golf swing in order to generate the optimal club head rotation rate. Thus, a moment arm having a distance D is created between the central axis of the wrist of the golfer's lower hand CA and the longitudinal axis of the golf shaft LAGS that acts as a cantilever arm and affects the efficiency with which the muscles of the lower arm and hand are utilized to transfer rotational force to the golf club and golf head. By insuring that a proper distance D is established between the axis of the golf shaft LAGS and the central axis of the wrist of the golfer's lower hand CA when the golfer's lower hand is placed on the grip, an average club head rotation rate substantially similar to the optimal club head rotation may be more consistently achieved.

In order to achieve the proper distance D between the longitudinal axis of the golf shaft LAGS and the central axis of the wrist of the golfer's lower hand CA, a standard golf club grip has an average grip diameter of approximately 21 mm, i.e., 0.827 inches, and is intended to be used with one of the three traditional gripping methods, which are described in detail above. As indicated above, all of these gripping methods require that the thumb of the golfer's upper hand is placed centrally on the top portion of the grip or on the top of the grip on the portion furthest away from the target. The fingers of the lower hand are then placed around the grip in a manner so that the lower hand encompasses both the grip and the thumb of the upper hand. The diameter and the resultant circumference that is created by the grip and the thumb of the upper hand determine the distance D that is established between the longitudinal axis of the golf shaft LAGS and the central axis of the wrist of the lower hand CA. Several sizes of standard golf grips are commonly available, varying from −1/32 inches to +1/8 inches, to accommodate variations in golfers' hand sizes while still establishing the proper distance D between the longitudinal axis of the golf shaft LAGS and the center axis of the wrist of the golfer's lower hand CA.

However, if the grip diameter is increased to a size that is larger than the optimal grip diameter for a particular golfer, which is often the case when an arthritic golfer utilizes an oversized grip, the distance D established between the longitudinal axis of the golf shaft LAGS and the center of the wrist of the golfer's lower hand CA will be decreased, i.e., a shorter moment arm will be formed, and the rotational force that needs to be applied to the golf club by the golfer's lower hand will be significantly increased. This increase in the rotational force that must be applied to the golf club by the golfer during the swing may result in the golfer being unable to consistently produce the force necessary to achieve both the maximum club head velocity and the optimal club head rotation rate, which are necessary to produce long, straight golf shots.

Additionally, if the grip diameter is decreased to a size that is smaller than the optimal grip diameter for a particular golfer, the distance D between the longitudinal axis of the golf shaft LAGS and the center axis of the wrist of the lower hand CA will be increased, i.e., a longer moment arm will be created. This increased distance D will significantly reduce the force that must be applied by the lower hand and fingers to rotate the club head properly through the impact area, but will dramatically increase the club head rotation rate to a speed far greater than the optimal club head rate of rotation of 2.5 degrees per inch through the impact area. This increase in the club head rotation rate will make consistent and solid contact with the golf ball much more difficult. This is caused by the club head being perpendicular to the target line for a much shorter period of time. As a result, golf shot directional control will become significantly more difficult.

In order to develop an oversized grip system that has grip sizes that establish the proper distance D between the longitudinal axis of the golf shaft LAGS and the center of the wrist of the golfer's lower hand CA, testing was initiated, as set forth in Example 1 below. Based on this testing, it was determined that oversized grips with grip diameters ranging from about 1.00 inch (25.4 mm) to about 1.20 inches (30.48 mm) resulted in the best golf shots. Additionally, it was found that golfers with larger than average hand sizes produced their best results with grips having larger diameters, while golfers with smaller than average hand sizes, produced their best results with grips having correspondingly smaller diameters. Thus, a grip size recommendation chart, as shown forth in Table 1 below, was created to correlate standard golf glove sizes to oversized grip diameters.

TABLE 1

Grip Size Recommendation Chart

| Golf Glove Size | Grip Diameter (inches) |
|---|---|
| Men's Small | 1.04 |
| Men's Medium | 1.07 |
| Men's Large | 1.10 |
| Men's X-Large | 1.13 |
| Men's XX-Large | 1.16 |

Figure 8:
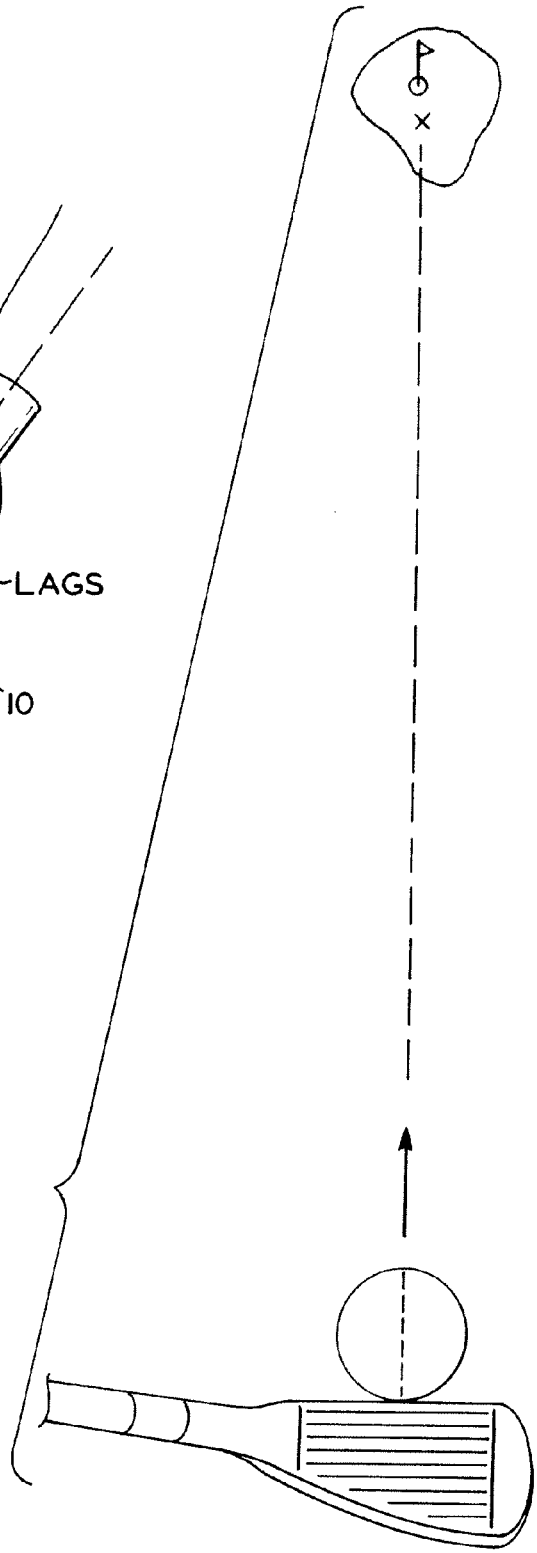
FIG. 8 is a depiction of a golf club making contact with a golf ball in a substantially squared condition.

Utilizing the grip size recommendation chart of Table 1, a second series of tests were performed in which the grip diameters of the oversized grips were limited to between about 1.04 inches (26.42 mm) and about 1.16 inches (29.46 mm). Additionally, the golfers were matched to the appropriately sized oversized grips based on their golf glove size as determined by the grip size recommendation chart of Table 1. As set forth in detail below in Example 2, when using a properly matched grip, golfers were able to produce golf shots of better quality when compared to the golf shots resulting using their original grips. Specifically, it was found that golfers utilizing their recommended grip size of oversized grips had golfer satisfaction scores that were substantially higher than the golfer satisfaction scores of golfers using oversized grips either one grip size smaller than or one grip size larger than their recommended grip size. As used herein, "golfer satisfaction score" is a subjective score assigned by the individual golfer to each golf shot immediately after each golf shot is taken. As shown in Table 2 below, each golfer satisfaction score is based on a 100 point Golfer Satisfaction Scale having one point increments, with 100 points indicating that the golfer thought that the shot was excellent and 0 points indicating that the ball did not move. The testing indicated that the use of the properly sized oversized grip provided more effective club head rotation, which was confirmed by high speed photography and videotape. Thus, when executed properly, the club face of a golfer utilizing properly fitted oversized grips arrives at impact with the golf ball in a square position in relation to the target, as shown in FIG. 8.

TABLE 2

Golfer Satisfaction Scale

| Assessed Golf Shot Quality | Assessed Points |
|---|---|
| Excellent | 100 |
| Good | 80 |
| Acceptable | 60 |
| Poor | 40 |
| Very Poor | 20 |
| Ball Did Not Move | 0 |

Figure 9:
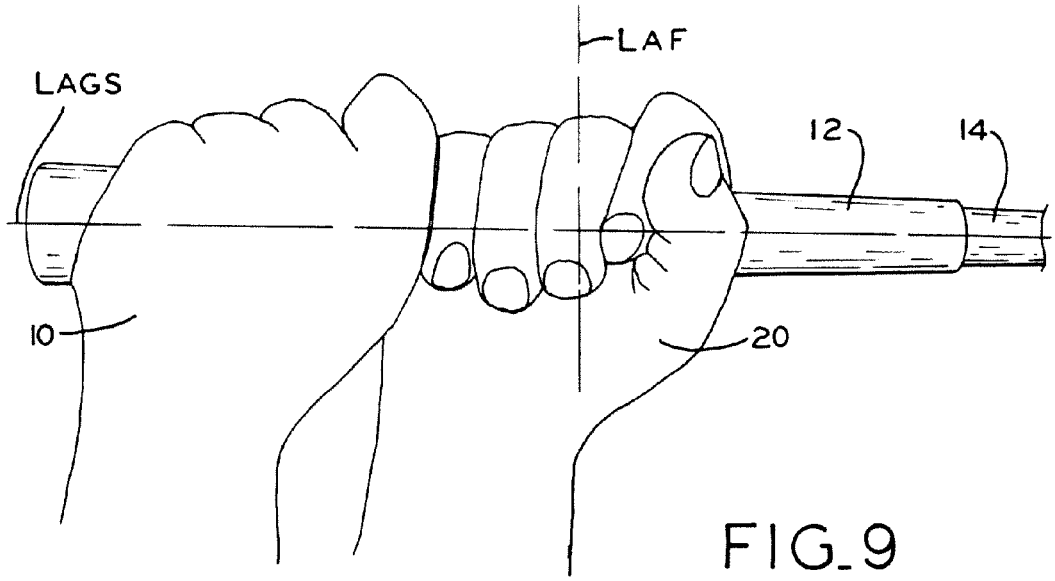
FIG. 9 is a perspective view of a pair of hands positioned on a golf grip in accordance with the baseball style gripping method.
Figure 10:
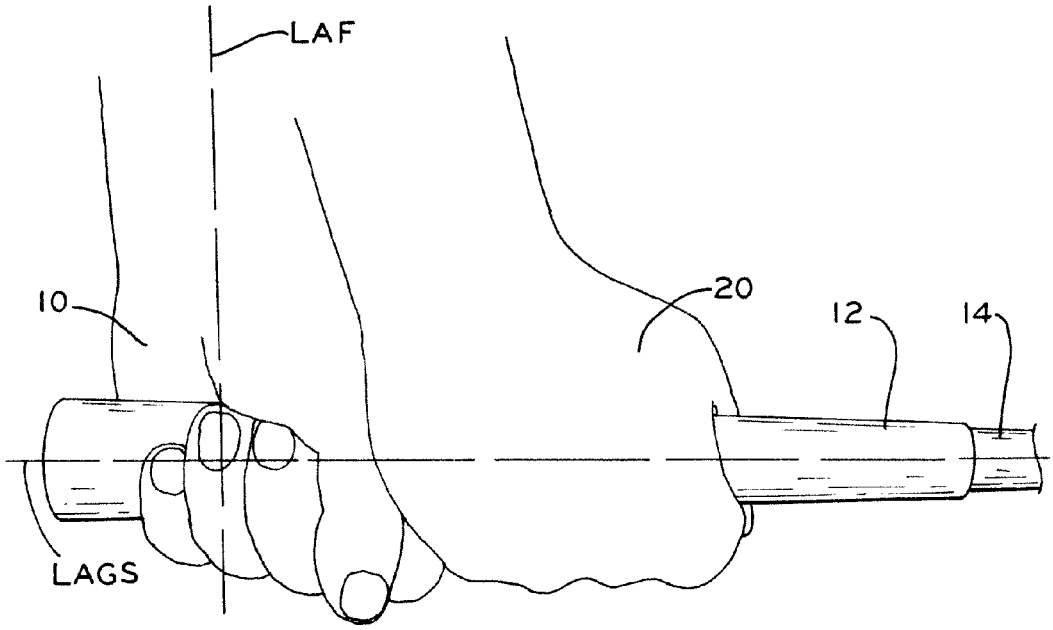
FIG. 10 is another perspective view of a pair of hands positioned on a golf grip in accordance with the baseball style gripping method.
Figure 11:
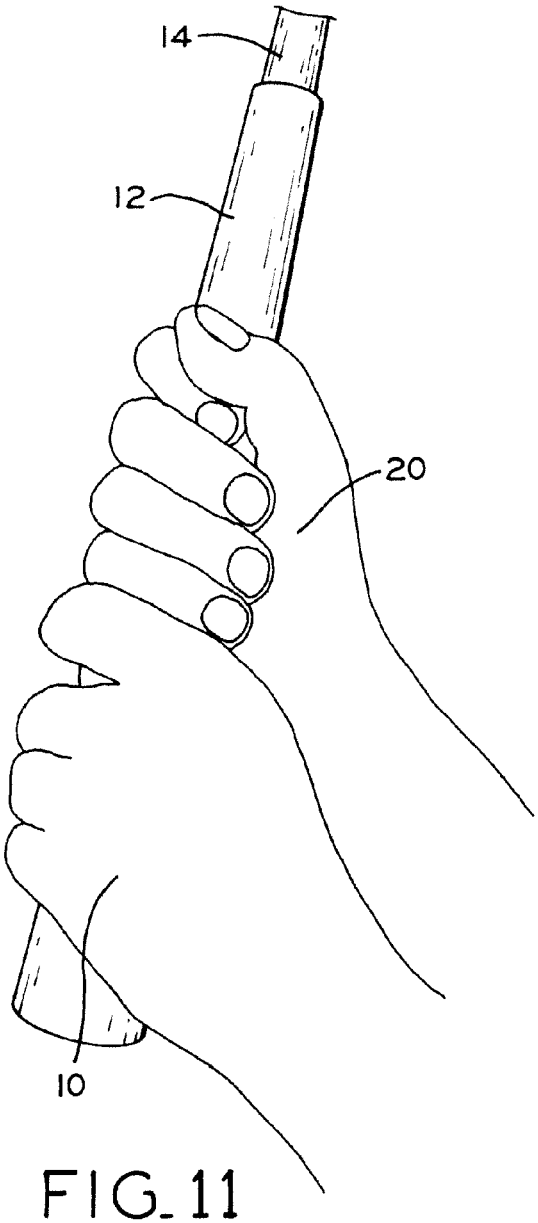
FIG. 11 is a perspective view of a pair of hands positioned on a golf grip in accordance with a partial baseball style/partial traditional gripping method.
Figure 12:
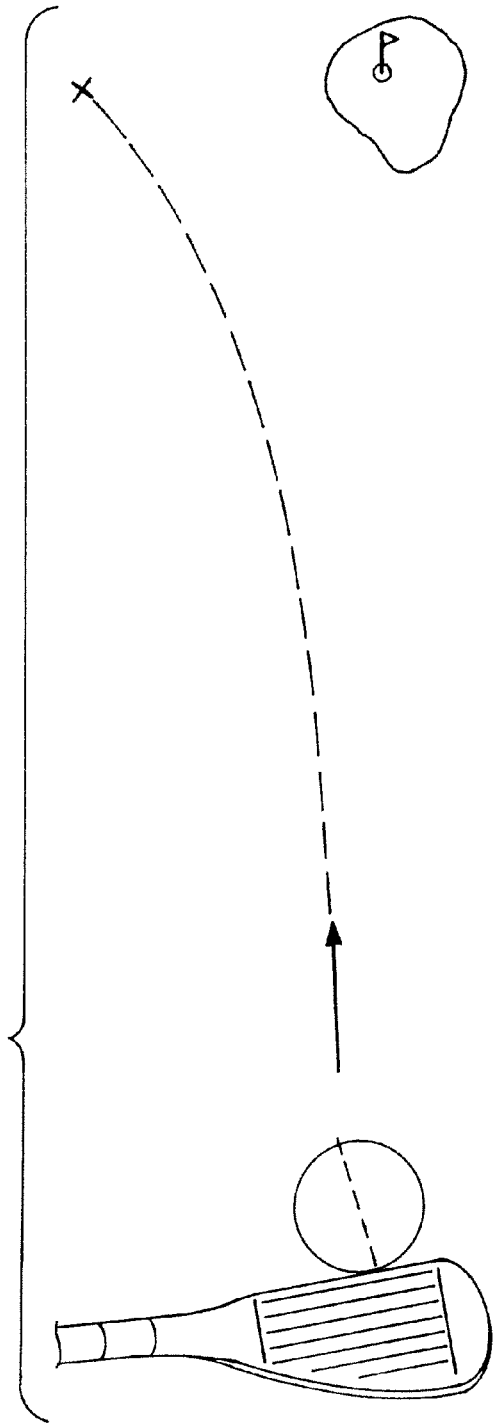
FIG. 12 is a depiction of a golf club making contact with a golf ball in an over rotated condition.

During the testing described above and in detail in Examples 1 and 2 below, it was noticed that some golfers would utilize a baseball-style method of gripping the oversized grip, as shown in FIGS. 9 and 10. In the baseball style method of gripping a golf grip, a golfer places their hands around the golf grip in a similar fashion as one would grasp a baseball bat. Referring to FIGS. 9 and 10, the fingers and palms of both upper and lower hands 10, 20 encircle golf grip 12 with the thumbs of both hands 10, 20 wrapped around grip 12 and overlapping the pointer fingers of their respective hand 10, 20. Grip 12 is oriented in hands 10, 20 so that the long axis of the golf shaft LAGS runs perpendicular to the long axis of the fingers LAF. As a result, this grasping method positions the wrist of the lower hand in an excessively bent or excessively arched position both at address and at the time of impact. As a result, the golfer would intermittently deliver the club face at impact so that it struck the ball in a slightly over-rotated position, as shown in FIG. 12. This causes the golfer to produce a pulled or hooked golf shot, i.e., a shot that curves to the left or right, respectively.

Alternatively, other golfers that participated in the testing would grasp the oversized grip with one of the traditional gripping methods, as shown in FIGS. 1-6. To reduce or eliminate the occurrence of a over-rotated club face at the time of impact, and its subsequent negative affects on the golf shot, research was begun to develop a new, more effective method of grasping and utilizing an oversized golf grip. This new method of gripping an oversized golf grip has been named the Diagonal Rotational Power ("DRP") method of gripping a golf club and, when used in conjunction with oversized grips, helps to ensure that the proper distance is established between the axis of the golf shaft LAGS and the center of the wrist of the lower hand CA, as discussed in detail above with reference to FIG. 7.

Figure 13:
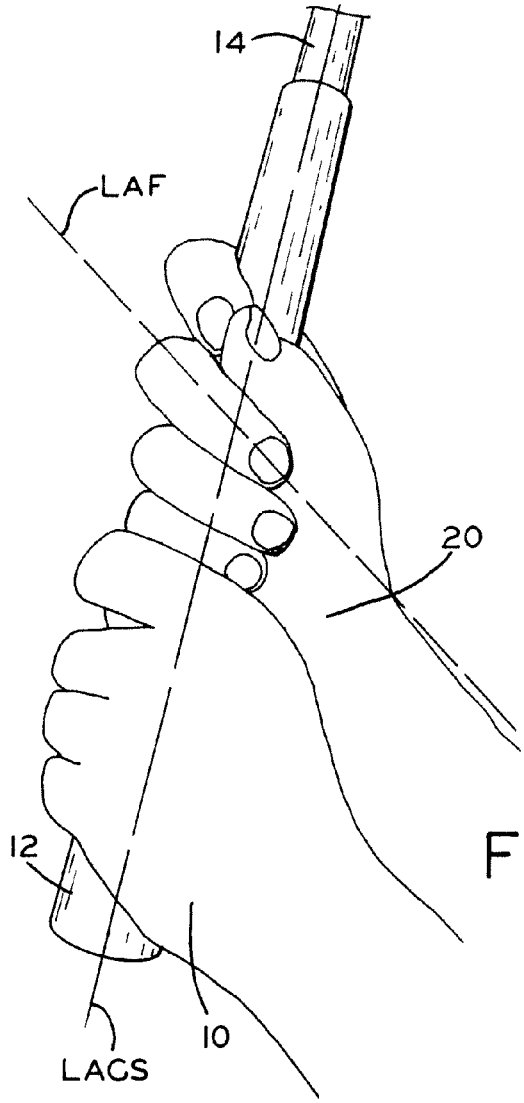
FIG. 13 is a perspective view of a pair of hands positioned on a golf grip in accordance with the Diagonal Rotational Power gripping method.
Figure 14:
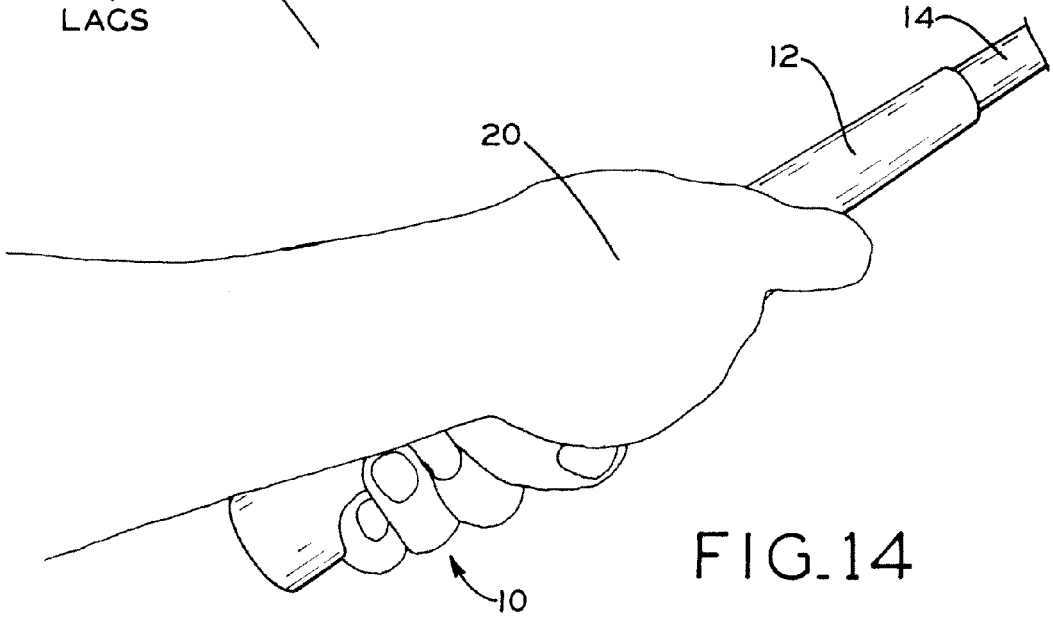
FIG. 14 is another perspective view of a pair of hands positioned on a golf grip in accordance with the Diagonal Rotational Power gripping method.

In contrast to the baseball style gripping method of FIGS. 9 and 10, by utilizing the DRP method of gripping an oversized golf club grip, as shown in FIGS. 13 and 14, the golfer places their hands 10, 20 around grip 12 on golf shaft 14 so that the fingers and palms encircle the grip. The thumbs of both hands 10, 20 are also wrapped around the grip, in a somewhat similar manner to the thumb placement utilized in the baseball style gripping method. However, as shown in FIG. 13, when utilizing the DRP method, the grip is oriented relative to the golfer's hands 10, 20 so that the long axis of the golf shaft LAGS runs at a diagonal angle to a long axis of the fingers LAF of lower hand 20. The thumb and index Finger of lower hand 20 are positioned so that the base and medial aspect of the thumb runs parallel to and rests against the medial aspect of the index finger. This positioning of lower hand 20 allows the lateral aspect of lower hand 20 to abut and rest against the anterior base of the thumb of upper hand 10, which assists the hands in working together as a single unit. The DRP gripping technique positions the wrist of lower hand 20 in a more neutral position both at address and at the time of impact. This allows the golfer to properly square the club face of the golf club at impact with the ball on a more consistent basis than is traditionally possible when utilizing the baseball style method of gripping the club.

As indicated above, the present grip system consists of larger than normal diameter golf grips. These oversized golf club grips are intended to be used in conjunction with a modified method of gripping the grip, specifically, the DRP gripping method described in detail above. However, the oversized grips of the present invention may also be used in conjunction with other gripping techniques, such as any of the three traditional gripping methods and the baseball style gripping method, for example. The grip diameters of the present system are enlarged by very precise amounts in order to replicate the circumference created when using traditional gripping methods, in which the lower hand grasps a correctly sized standard golf grip and the thumb of the upper hand is captured by the fingers and palm of the lower hand.

In this manner, when used with the DRP gripping method, the oversized grips of the present invention duplicate the ideal cantilever arm lengths formed between the axis of the golf club shaft and the central axis of the wrist of the golfer's lower hand, as described above. Thus, in order to form a golf club grip system that achieves the benefits described above, a grip system having, in one exemplary embodiment, five different grip sizes was developed. These grips may have a grip diameter measured prior to being installed on a golf club shaft ranging from as small as 25.0 mm, 25.2 mm, 25.5 mm, 25.7 mm, or 26.0 mm to as large as 29.0 mm, 29.2 mm, 29.5 mm, 29.7 mm, or 30.0 mm. In one exemplary embodiment, the golf grips range in grip diameters from 25.7 mm to 29.7 mm prior to being installed on a golf club shaft. Installation of the grips on the golf clubs causes the grips to expand by approximately 0.3 mm in diameter. Thus, the grips may have resultant post-installation grip diameters as small as 25.3 mm. 25.5 mm. 25.8 mm, 26.0 mm, or 26.3 mm and as large as 29.3 mm. 29.5 mm, 29.8 mm, 30.0 mm, or 30.3 mm. In one exemplary embodiment, the grips have resultant post-installation grip diameters ranging from 26.0 mm to 30.0 mm.

Figure 17:
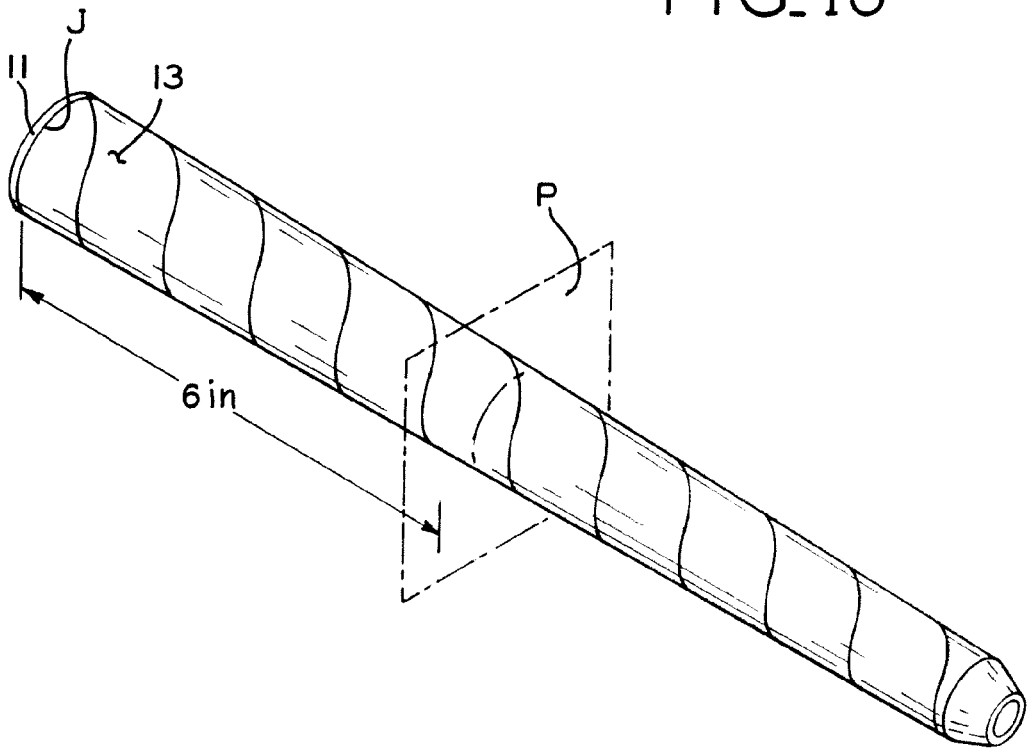
FIG. 17 is a perspective view of a golf grip of the present invention depicting plane P extending therethrough.

By having a grip system that utilizes grip diameters within the above-identified range, in conjunction with the lower hand placed directly on the grip without the thumb of the upper hand captured between the grip and palm of the lower hand, the circumferences created when golfers grip standard size golf grips with the thumb of the upper hand captured between the grip and the palm of the lower hand are substantially replicated. Additionally, in order to ensure that the proper cantilever arm lengths arc established, the total grip wall thicknesses of each of the grip sizes after installation on a golf club shaft must be no thinner than substantially 5.6 mm and no thicker than substantially 7.6 mm, when standard golf shafts and standard installation techniques are used. Absent an indication to the contrary, as used herein, "grip wall thickness" refers to the thickness extending radially between inner surface 103 of inner layer 110 and gripping surface 13 of the outer wrap of a cross-section of a grip taken in a direction perpendicular to the longitudinal axis of the grip at a distance of about 158 mm from the proximal end of the golf grip defined by cap end 11, as depicted in FIG. 17. Additionally, by taking various measurements of the golf grip, such as grip diameter and grip wall thickness, in the central portion of the golf club grip, such as at a distance of about 158 mm from the proximal end of a golf club grip having a standard length gripping surface, the measurements are taken in an area of the golf grip that is grasped by the golfer during a golf swing and, as a result, has an effect on the resulting golf shot.

Figure 16:
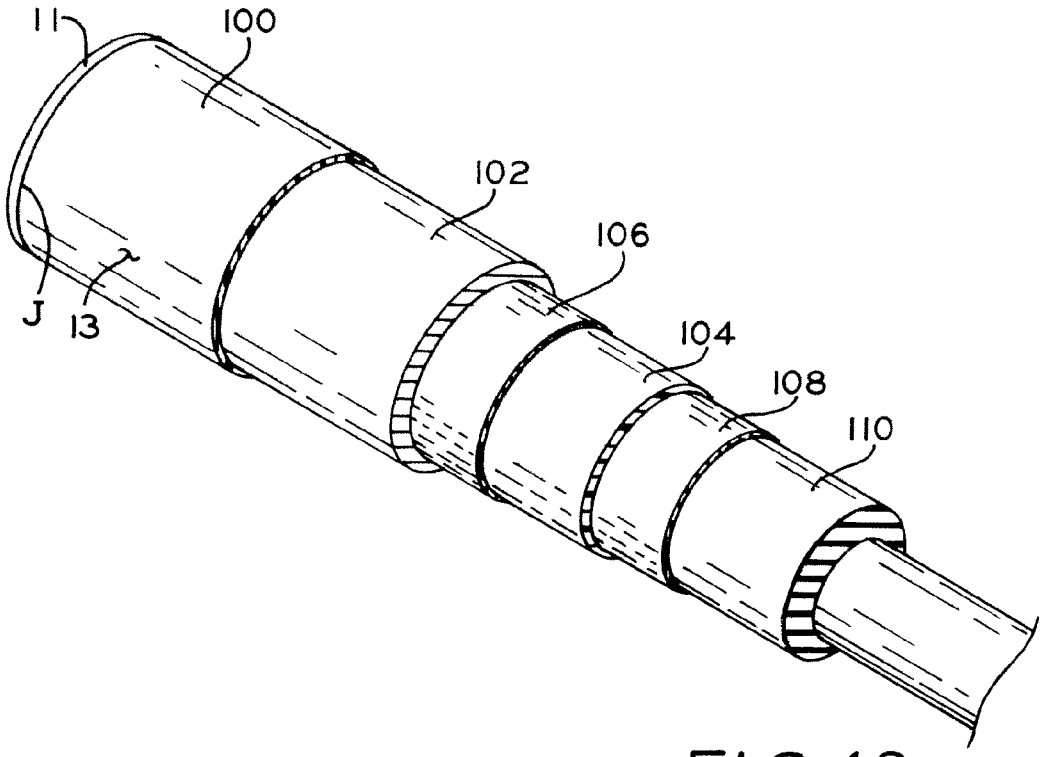
FIG. 16 is a perspective, partial cross-sectional view of the golf grip of the present invention depicting the individual layers forming the golf grip.

In one exemplary embodiment, this results in ratio ranges between the grip diameter and the grip wall thickness at about 158 mm from the proximal end of the golf club grip defined by cap end 11, shown in FIG. 16, in which the grip diameter must be no less than 3.8 times greater than the grip wall thickness and no more than 4.7 times greater than the grip wall thickness. In another exemplary embodiment, ratio ranges between the grip diameter and the grip wall thickness at about 158 mm from the proximal end of the golf club grip defined by cap end 11 in which the grip diameter must be no less than 3.95 times greater than the grip wall thickness and no more than 4.64 times greater than the grip wall thickness. Specific ratio ranges between the grip diameter and the grip wall thickness for exemplary embodiments are set forth in Table 3 below for both pre-installation grip diameters, i.e., before the grip is installed on a golf club shaft, and post-installation grip diameters. i.e., after the grip is installed on a golf club shaft.

TABLE 3

Grip Diameter to Grip Wall Thickness Ratios

| Grip Diameter (in mm) | Ratio of Grip Wall Thickness to Grip Diameter |
|---|---|
| 25.7 (pre-installation) | 1:4.64 |
| 26.0 (diameter of the 25.7 mm grip after installation on a standard golf club shaft) | 1:4.59 |
| 26.7 (pre-installation) | 1:4.38 |
| 27.0 (diameter of the 26.7 mm grip after installation on a standard golf club shaft) | 1:4.43 |
| 27.7 (pre-installation) | 1:4.20 |
| 28.0 (diameter of the 27.7 mm grip after installation on a standard golf club shaft) | 1:4.24 |
| 28.7 (pre-installation) | 1:4.04 |
| 29.0 (diameter of the 28.7 mm grip after installation on a standard golf club shaft) | 1:4.08 |
| 29.7 (pre-installation) | 1:3.91 |
| 30 (diameter of the 29.7 mm grip after installation on a standard golf club shaft) | 1:3.95 |

In order to confirm the advantages of the DRP gripping method, comparative testing between the baseball style gripping method and the DRP gripping method was performed, as set forth below in Example 3. Based on this testing, the golf shots executed with the baseball style gripping method had an average golfer satisfaction score of 57.3, while golf shots executed with the DRP gripping method had an average golfer satisfaction score of 69.8. Additional comparative testing, the details of which are set forth below in Example 4, was performed to compare golfer satisfaction scores obtained by using standard size golf grips and the Vardon gripping method with golfer satisfaction scores obtained by using oversized golf grips and the DRP gripping method. Based on this testing, it was determined that golfers utilizing the standard size grips and the Vardon gripping method had an average golfer satisfaction score of 46.1. In contrast, golfers using the oversized grips and the DRP gripping method had an average golfer satisfaction score of 69.8.

An additional advantage is provided by utilizing oversized grips and the DRP gripping method. Specifically, the total surface contact area that the lower hand has on the golf grip is increased, which influences the amount of rotational force that the lower hand and arm can apply to the golf club during a golf swing. Placement of the hands on the standard golf grip using any of the three traditional gripping methods, discussed in detail above, results in the golfer positioning the thumb of the upper hand between the grip and the fingers and palm of the lower hand. By moving the upper hand thumb from its traditional position, such as in the manner described in detail above with reference to the DRP gripping method, a significant increase in the surface area of the finger and palm of the lower hand that is in direct contact with the grip is achieved. This results in a greater rotational force that can be applied to the grip by the lower hand and arm during the golf swing.

In order to determine the increase in the rotational force that could be applied to a golf club utilizing the oversized grips of the present invention and the DRP gripping method, testing was performed using a dial torque wrench. A first end of the dial torque wrench was mounted in a fixed position to a fixed floor mount. The opposing end of the dial torque wrench had a handle that accepted a ¼ inch female socket drive. Two equivalent golf shafts having head ends with a ¼ inch male socket drive permanently fixed to the shaft were alternatively engaged with the ¼ inch female socket drive on the handle of the dial torque wrench. One golf shaft had a standard diameter golf grip. i.e., a golf grip having a 21 mm grip diameter, and a standard gripping technique was used to rotate the shaft. The second golf shaft had a 27.7 mm grip formed in accordance with the present invention and the DRP gripping technique was used to rotate the shaft. Golfers of various ages and ability turned each of the shafts as firmly as possible in a rotational direction in which the target would typically be located. Based on the testing, golfers were able to generate, on average, 38.7% more rotational force using the 27.7 mm grip and the DRP gripping method as opposed to utilizing the standard diameter golf grip with one of the three traditional gripping methods.

Due to the added rotational force that a golfer can place on an oversized golf grip, as discussed in detail above, the torsion of the grip must be low enough that rotation of the grip between the golf club shaft and the golfer's hands does not significantly impact the golf shots. However, to provide a gripping surface that can be gripped by an arthritic golfer without causing pain and/or inflammation in the golfer's hand while also providing an grip the allows the arthritic golfer to produce the best golf shots possible, two competing concerns must be balanced. Specifically, the elastic deformation of the grip, i.e., the ability of an arthritic golfer to compress and comfortably grasp the grip in their hand, must be sufficient to prevent pain and/or inflammation. At the same time, the grip must be torsion resistant enough to prevent unnecessary rotation of the grip between the golf club shaft and the golfer's hands.

Based on testing of elastic deformation, set forth below in Example 5, it was determined than an acceptable range of elastic deformation under a 5 pound compressive load would be at least 1.0 mm to no more than 2.0 mm, while an acceptable range of elastic deformation under a 15 pound compressive load would be at least 1.5 mm and no more than 3.0 mm. As used herein, the phrase "elastic deformation" refers to the amount of compression experienced by a golf grip mounted on a golf shaft as calculated using the method set forth below in Example 5. Additionally, based on the testing of grip torsion, set forth below in Example 6, it was determined that the acceptable range of torsion that a golf grip should experience between the golf shaft and the hands of a golfer is at least 5.0 degrees and no more than 20.0 degrees. As used herein, the phrase "degree of torsion" refers to the amount of torsion that a golf grip experiences as calculated using the method set forth in Example 6 below. In forming the oversized grips of the present invention to provide an elastic deformation and a range of torsion that are within the above-identified acceptable ranges, a series of individual layers of material are assembled to form a grip body. These layers are assembled so that each layer comprises a specific ratio of the overall thickness of the golf club grip. These layer ratios, set forth in Tables 7 and 8 and described below, significantly contribute to the benefits provided by the present golf club grip system.

Figure 15:
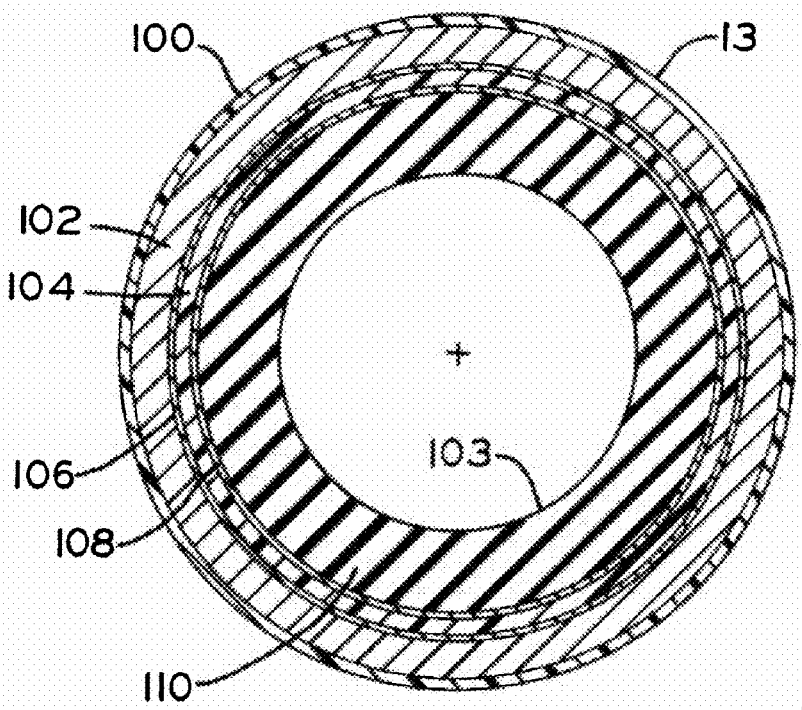
FIG. 15 is a longitudinal cross-sectional view of a golf grip of the present invention taken along plane P in FIG. 17.

Referring to FIGS. 15 and 16, the outer wrap of the grip provides the golfer with a non-slip gripping surface and dampens impact shock and vibrations to provide the golfer with a grip that substantially lessens any pain and/or inflammation experienced when grasping the grip and striking a golf ball. Thus, the outer wrap must be sufficiently thick to provide the proper dampening effects, but also must be thin enough to prevent unnecessary twisting of the grip between the hands of the golfer and the golf shaft during a golf swing. As a result, the outer wrap should have low density and a medium to high deformation. For example, in one exemplary embodiment, the outer wrap has a Shore A hardness as low as 10, 15, 20, or 25 Shore A hardness units and as high as 30, 35, 40, or 45 Shore A hardness units. All Shore A hardness measurements set forth herein were achieved using ASTM Standard 2240, Standard Test Method for Rubber Property-Durometer Hardness.

In one exemplary embodiment, the outer wrap is a combination of several different, individual layers of material that are secured together. Referring to FIGS. 15 and 16, in one exemplary embodiment, the outer wrap is formed from first polyurethane layer 100, felt layer 102, and second polyurethane layer 104, which are secured together, in part, by adhesive strip 106. Additionally, referring to Table 4 below, in one exemplary embodiment, first polyurethane layer 100, felt layer 102, and second polyurethane layer 104 have thicknesses of 0.76 mm, 1.02 mm, and 0.13 mm, respectively. In another exemplary embodiment, felt layer 102 has a thickness of 0.52 mm.

TABLE 4

Thicknesses of Individual Components of the Outer Wrap

| Component of the Outer Wrap | Thickness for Pre-Installation Grip Sizes 25.7 mm and 26.7 mm (in mm) | Thickness for Pre-Installation Grip Sizes 27.7 mm, 28.7 mm, and 29.7 mm (in mm) |
|---|---|---|
| Outer Polyethylene Layer | 0.76 | 0.76 |
| High Density Felt Layer | 0.52 | 1.02 |
| Adhesive Layer Between Felt Layer and High Density Polyurethane Layer | 0.04 | 0.04 |
| Inner High Density Polyurethane Layer | 0.13 | 0.13 |
| Adhesive Layer Between Inner Polyurethane Layer and Inner Grip Layer (i.e., the underlisting) | 0.10 | 0.10 |
| Total Thickness of the Outer Wrap | 1.55 | 2.05 |

In one exemplary embodiment, felt layer 102 is a sheet of material that is formed from a natural fiber mat. For example, felt layer 102 may be substantially similar to the felt layer used in X-Tack brand golf grips, commercially available from Karakal Golf Grips as product number YZ-RD/SL-PUB. In one exemplary embodiment, the first step in forming the golf grip is applying first polyurethane layer 100 to felt layer 102. Specifically, felt layer 102 is passed over the surface of a vat of liquified, low density polyurethane to deposit first polyurethane layer 100 thereon. In one exemplary embodiment, polyurethane layer 100 is formed from a polyurethane substantially similar to the polyurethane used in Pro Soft™ Tennis Racquet Overgrips, commercially available from Wilson Tennis as product number WRZ4733.

Next, first polyurethane layer 100 and felt layer 102 are passed through a series of rollers to interdigitate the fibers of felt layer 102 into a portion of polyurethane layer 100. This bonds polyurethane layer 100 and felt layer 102 together. Referring to Table 5 below, in one exemplary embodiment, first, low density polyurethane layer 100 has a Shore A hardness as low as 10, 15, or 20 Shore A harness units and as high as 25, 30, or 35 Shore A hardness units. Shore A harness measurements for other layers of the grip are also set forth in Table 5.

TABLE 5

Durometer Shore A Hardness Scale Ratings for Individual Materials Used in the Construction of the Present Golf Grip and Related Materials Measured in Accordance with ASTM Standard 2240

| Material | Shore A Hardness Rating |
|---|---|
| Outer Polyurethane Layer of the Outer Wrap | 20 +/− 5 |
| Fiber Felt Layer of the Outer Wrap | 45 +/− 5 |
| Inner Polyurethane Layer of the Outer Wrap | 72 +/− 5 |
| Synthetic Rubber Inner Layer | 70 +/− 5 |
| Elatron D brand elastomer commercially available from Elaston Kimya A.S. | 20 +/− 5 |
| Prince Tennis Cushion Fit ™ brand tennis racquet replacement grip commerically available from Prince Sports, Inc., as part number UBS 7H101020080 | 20 +/− 5 |

Once polyurethane layer 100 and felt layer 102 are secured together, adhesive strip 106 is applied to the undersurface of felt layer 102. In one exemplary embodiment, adhesive strip 106 is a pressure sensitive adhesive. In this embodiment, adhesive strip 106 includes a transparent polyester intermediate layer with adhesive applied to opposing sides of the polyester intermediate layer. The construct is then passed through a series of rollers to activate the adhesive and to interdigitate the adhesive with openings formed between the fibers of felt layer 102. In one exemplary embodiment, adhesive strip 106 has a thickness of 0.04 mm.

Once adhesive strip 106 is adhered to felt layer 102, second polyurethane layer 104, which is formed from a high density polyurethane, is positioned adjacent adhesive strip 106 and passed through a series of pressure rollers to secure second polyurethane layer 104 to felt layer 102 via adhesive strip 106. In one exemplary embodiment, polyurethane layer 104 is formed from a polyurethane substantially similar to the polyurethane used in Series R Moldon Rubber-Tired Wheels, commercially available from Hamilton Caster as product number W-820-R-3/4. Additionally, in one exemplary embodiment, second, high density polyurethane layer 104 has a Shore A hardness as low as 55, 60, 65, or 70 Shore A hardness units and as high as 75, 80, 85, or 90 Shore A hardness units. In one exemplary embodiment, polyurethane layer 104 has a Shore A harness of approximately 70 Shore A hardness units.

Once first polyurethane layer 100, felt layer 102, second polyurethane layer 104, and adhesive strip 106 are secured together, thin adhesive strip 108 is applied to the underside of second polyurethane layer 104. In one exemplary embodiment, adhesive strip 106 and adhesive strip 108 are substantially similar to the adhesive layers used in X-Tack brand golf grips, commercially available from Karakal Golf Grips as product number YZ-RD/SL-PUB. In one exemplary embodiment, adhesive strip 108 has a thickness of 0.10 mm. In one exemplary embodiment, the adhesive used in adhesive strip 106 and adhesive strip 108 is a pressure sensitive adhesive, i.e., an adhesive that forms a bond when a pressure is applied to join the adhesive to the adherend. In this embodiment, once adhesive strip 108 is applied to the underside of the outer wrap of the grip, the outer warp and adhesive strip 108 may be passed through a series of rollers to activate adhesive strip 108. Additionally, the amount of bonding of adhesive strip 106 and adhesive strip 108 to the adherend may be controlled and/or modified by adjusting the amount of pressure applied by the set of pressure rollers.

This construct, including first polyurethane layer 100, felt layer 102, adhesive strip 106, second polyurethane layer 104, and adhesive strip 108 form the outer wrap of the grip. The outer wrap is then applied to inner layer 110, i.e., the underlisting, of the grip, which is the only component defining the inner grip layer. Specifically, the outer wrap is in the form of a strip that is secured to inner layer 110 by spiral wrapping the outer wrap around an outer surface of inner layer 110, which will form the inner core of the grip, in a known manner. In one exemplary embodiment, the outer wrap is wrapped around inner layer 110 manually. In another exemplary embodiment, the wrap construct is wrapped around inner layer 110 using an automated process. A thin rubber nipple (not shown) on the end of inner layer 110, which is positioned nearest the club head when installed on a golf club, is then folded over the terminal end of the wrap construct to secure the wrap construct to inner layer 110 and to maintain the bond between the end of the outer wrap and inner layer 110. Additionally, irrespective of the method used to position the outer wrap of the grip around inner layer 110, as the outer wrap is pulled taught and positioned around inner layer 110, the tension on inner layer 110 and adhesive strip 108 work together to secure the outer wrap of the grip to inner layer 110.

In order to provide the golfer with a substantially firm inner surface that lessens any torsion of the grip during a golf swing, inner layer 110 must be sufficiently thick to provide the proper torsion resistance, as identified above, while being thin enough to prevent any significant negative impact on a golfer attempting to sufficiently grasp the golf grip. As a result, inner layer 110 should be a substantially compression and torque resistant layer with a medium to high tensile strength. In one exemplary embodiment, inner layer 110 is formed as a thick, dense, synthetic rubber layer. For example, inner layer 110 may by formed from a synthetic rubber, such as ethylene propylene diene M-class rubber ("EPDM"). In one exemplary embodiment, the EPDM may have material properties substantially similar to the material properties of the EPDM used to form the 9 inch EPDM Tarp Strap, commercially available from Ace Hardware Corporation of Oak Brook, Ill., as product number 71282 having the Universal Product Code of 082901712824.

As discussed above and identified below in Tables 6 and 7 below, exemplary ratios between the inner layer thickness and the outer wrap thickness of the golf grip, significantly contribute to the benefits provided by the present golf grip system. As used herein, "outer wrap thickness" refers to the thickness of a cross-section of the outer wrap, i.e., the combined thickness of first polyurethane layer 100, felt layer 102, adhesive strip 106, second polyurethane layer 104, and adhesive strip 108, extending radially between an innermost surface defined by the interior surface of adhesive strip 108 to a radially outermost surface defined by the exterior surface of first polyurethane layer 100 and taken in a direction perpendicular to the longitudinal axis of the grip and measured at a distance of about 158 mm from the proximal end of the golf club grip defined by cap end 11, as shown in FIG. 17.

Similarly, absent an indication to the contrary, as used herein, "inner layer thickness" refers to the thickness of a cross-section of the inner layer, i.e., inner layer 110, extending radially between the innermost surface of inner layer 110 defined by inner surface 103 and the radially outermost surface of inner layer 110 and taken in a direction perpendicular to the longitudinal axis of the grip and measured at a distance of about 158 mm from the proximal end of the golf club grip defined by cap end 11, which is depicted in FIG. 17. In one exemplary embodiment, the inner grip thickness should be no less than 2.3 times thicker than the outer wrap thickness and not more than 3.1 times thicker than the outer wrap thickness. With reference to Table 6, in one exemplary embodiment, the grip wall thickness should be no less than 1.30 times thicker than the inner wall thickness and no more than 1.45 times thicker than the inner wall thickness. Additionally, in one exemplary embodiment, the grip wall thickness should be no less than 3.0 times thicker than the outer wall thickness and no more than 4.1 times greater than the outer wall thickness.

TABLE 6

Inner Layer, Outer Wrap, and Total Grip Wall Thicknesses and Ratios

| Grip Diameter Pre-Installation (in mm) | Inner Layer Thickness (in mm) | Outer Wrap Thickness (in mm ) | Total Grip Wall Thickness (in mm) | Ratio of Inner Layer Thickness to the Total Grip Wall Thickness | Ratio of the Outer Wrap Thickness to the Total Grip Wall Thickness |
|---|---|---|---|---|---|
| 25.7 | 4.10 | 1.5 | 5.60 | 1:1.37 | 1:3.73 |
| 26.7 | 4.60 | 1.5 | 6.10 | 1:1.33 | 1:4.07 |
| 27.7 | 4.60 | 2.0 | 6.60 | 1:1.44 | 1:3.30 |
| 28.7 | 5.10 | 2.0 | 7.10 | 1:1.39 | 1:3.55 |
| 29.7 | 5.60 | 2.0 | 7.60 | 1:1.36 | 1:3.80 |

TABLE 7

Percentage of Total Grip Wall Thickness Defined by the Outer Wrap and the Inner Layer

| Grip Diameter Pre-Installation (in mm) | Percentage of the Total Grip Wall Thickness Formed by the Inner Layer | Percentage of the Total Grip Wall Thickness Formed by the Outer Wraper | Ratio of the Inner Layer to the Outer Wrap |
|---|---|---|---|
| 25.7 | 73.2 | 26.8 | 2.733:1 |
| 26.7 | 75.4 | 24.6 | 3.067:1 |
| 27.7 | 69.7 | 30.3 | 2.300:1 |
| 28.7 | 71.8 | 28.2 | 2.550:1 |
| 29.7 | 73.7 | 26.3 | 2.800:1 |

Once formed, in order to install a grip on the shaft of a golf club, the proper grip for the individual golfer, as determined in accordance with the grip size recommendation chart of Table 1, is selected. Since standard golf shafts have a maximum diameter of 0.600 inches to 0.605 inches, i.e., 15.24 mm to 15.37 mm, when a golf grip is installed on a standard golf shaft, the grip diameter is expanded. This expansion of the golf club grip averages approximately 0.10 inches, i.e., 0.3 mm, and is taken into account in the golf club grip size recommendation chart of Table 1.

However, some golf clubs, such as drivers, fairway woods, and/or utility clubs, have maximum golf shaft diameters that are larger than the standard golf shaft diameter. For example, the golf shaft diameters may be as large as 0.615 inches to 0.625 inches, i.e., 15.62 mm to 15.88 mm. These larger than standard golf shaft diameters cause greater than normal expansion of the golf grip after it is installed on the golf club, resulting in total golf grip expansion of 0.024 inches to 0.039 inches, i.e., 0.6 mm to 1.0 mm. To compensate for the extra expansion of the grip by golf shafts having larger than standard golf shaft diameters, a grip one size smaller than the size recommended by the golf grip size recommendation chart of Table 1 may be used. This will correct for the over expansion and result in the desired post-installation grip diameter. In contrast, when golf shafts having golf shaft diameters that are less than 0.595 inches, i.e., 15.113 mm, are used, the proximal portion of the shaft should be built up to the diameter of approximately 0.600 inches, i.e., 15.24 mm, with the use of shaft build up tape. The proper build up of undersized shafts helps ensure that the final installed grip diameter is the proper diameter, as well as helps ensure that the grip is properly affixed on the golf shaft before the shaft is used.

Once a golf club grip having the proper grip diameter is selected, a layer of golf grip tape with an adhesive on both sides is positioned on the proximate end of the golf shaft. Depending on the type of adhesive that is utilized on the golf grip tape, either a solvent or soapy water is sprayed and/or poured over the tape. The golf grip is then promptly slid over the taped golf shaft and placed in the desired position. The newly gripped golf club is then set aside until the necessary evaporation and set-up times have elapsed. Once these times have elapsed, the golf club is ready for use.

Additional adjustments involving the grip size and installation may need to be made if the golf club shaft contains parallel-sided proximal sections or if the shaft has a taper angle that is lower than a standard golf shaft tapered angle. The use of either of these types of golf shafts causes greater than normal expansion to the middle and/or distal portions of the grip after it has been installed in golf clubs.

Utilizing the oversized grip system of the present invention, arthritic golfers, with their associated reduced finger flexion and strength can comfortably grasp the larger diameter grips and swing the golf club without any reduction of the maximum club head velocity or optimal club head rotational rate. As a result, this grip system provides equal or superior protection from shock and vibration without the undesirable increase in grip torsion of previous arthritic golf grips. Further, the design of the grip system helps to reduce the unavoidable loss of golf shot performance experience when utilizing oversized, arthritic grips.

EXAMPLES

The following non-limiting Examples illustrate various features and characteristics of the present invention, which is not to be construed as limited thereto.

Example 1

Preferred Increased Golf Grip Diameters for Individual Golfers

Over 75,000 golf shots were executed by amateur golfers ranging in individual ability with United States Golf Association handicaps of between 4 and 35. Each test golfer used a variety of golf clubs that were all fitted with oversized golf grips. Prototype oversized golf grips were manufactured having grip diameters varying by 0.05 inches and having a minimum grip diameter of 1.0 inch and a maximum grip diameter of 1.5 inches. All measurements of the golf grip diameter were taken post installation, i.e., after the grip had been properly installed on a golf club, and at a point on the grip 6.0 inches from junction J, shown in FIG. 16, defined by cap end 11 and gripping surface 13 of the golf grip, in a similar manner as described in detail above. Additionally, each of the grips had a 0.60 inch standard grip size internal diameter. By utilizing golf grips having a maximum grip diameter of 1.50 inches, all of the grips were within the maximum legal dimensions allowed by the United States Golf Association, which require a grip diameter of less than 1.75 inches. Testing was also done with standard size golf grips utilizing traditional grasping techniques.

In order to observe, score, collect, and record all test golf shots, the golfer satisfaction scale, shown in Table 2 above, was used. Specifically, the golfer who performed the individual shot was asked to evaluate the shot and assign it a golfer satisfaction score based on the 0 to 100 point golfer satisfaction scale, which is divided into one point increments. These results were recorded and tabulated. Each golfer was required to hit golf shots using all of the available grip sizes in the series. Some test golfers preferred to grasp the oversized grips the same way one would hold a baseball bat. However, most golfers held the oversized golf grips in a fashion that was part baseball like grip and part traditional golf type grip.

Figure 18:
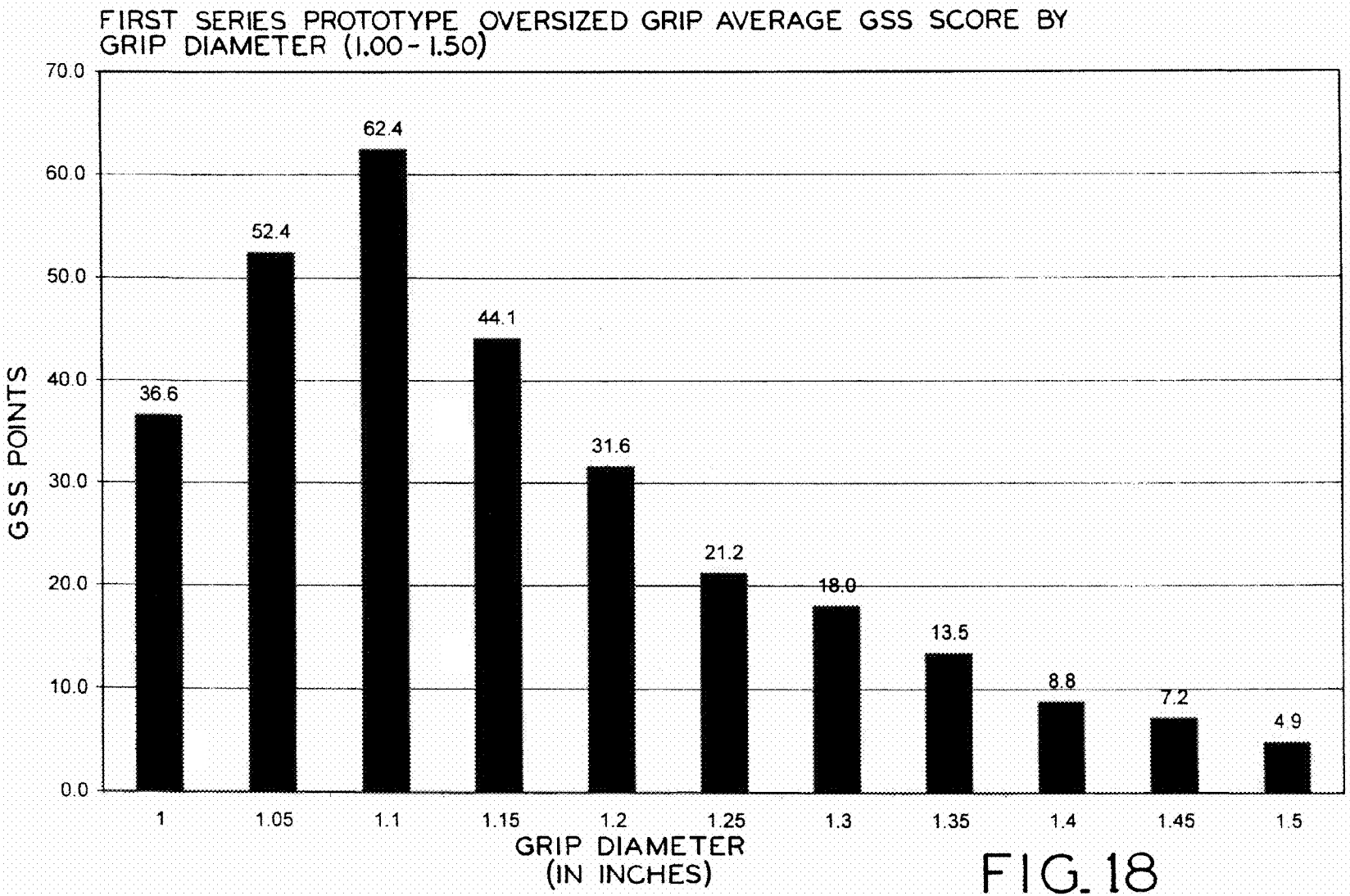
FIG. 18 is a graph of golfer satisfactions scores correlated to golf grip diameter.
Figure 19:
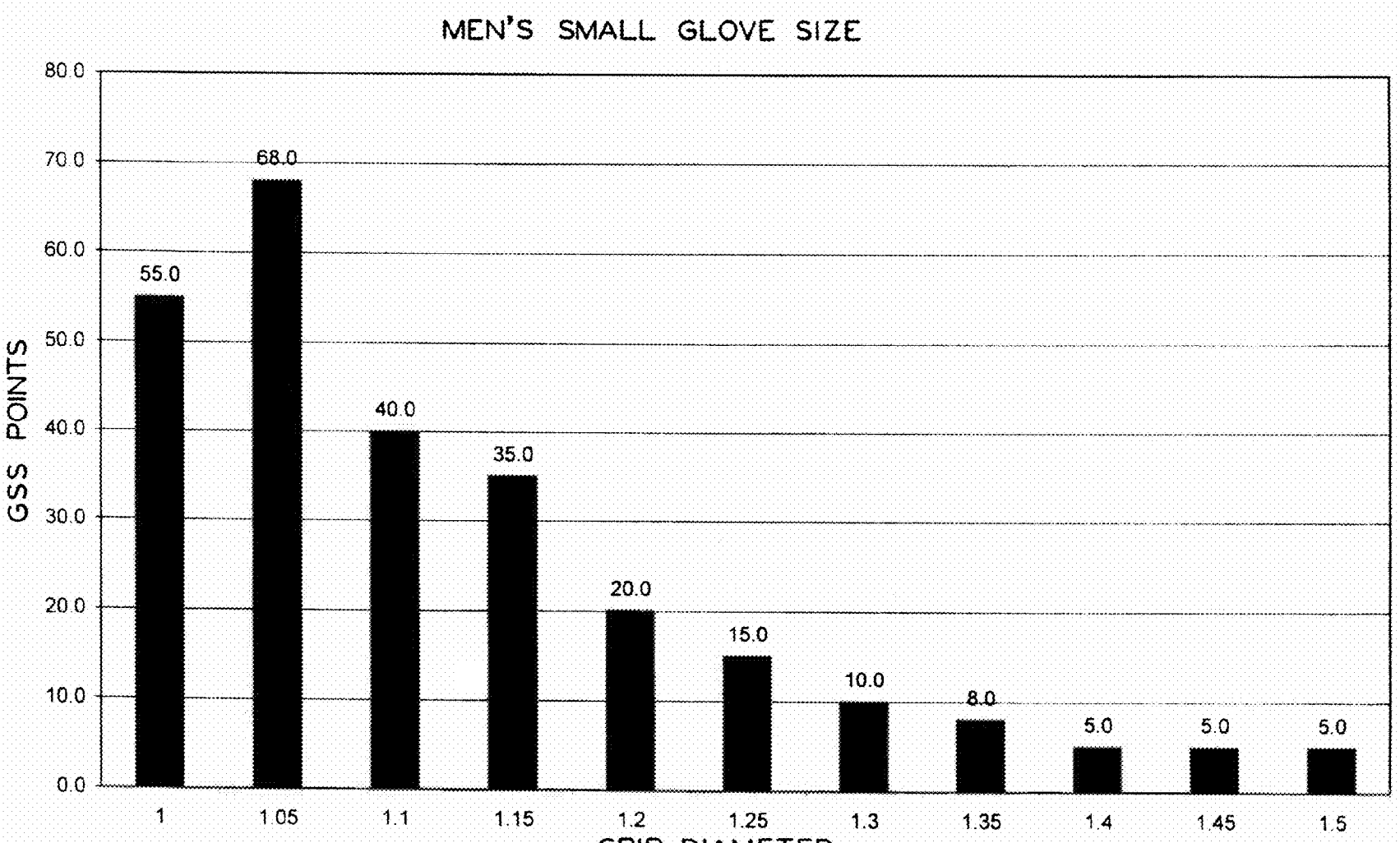
FIG. 19 is a graph of golfer satisfactions scores correlated to golfer's wearing a small men's golf glove size.
Figure 20:
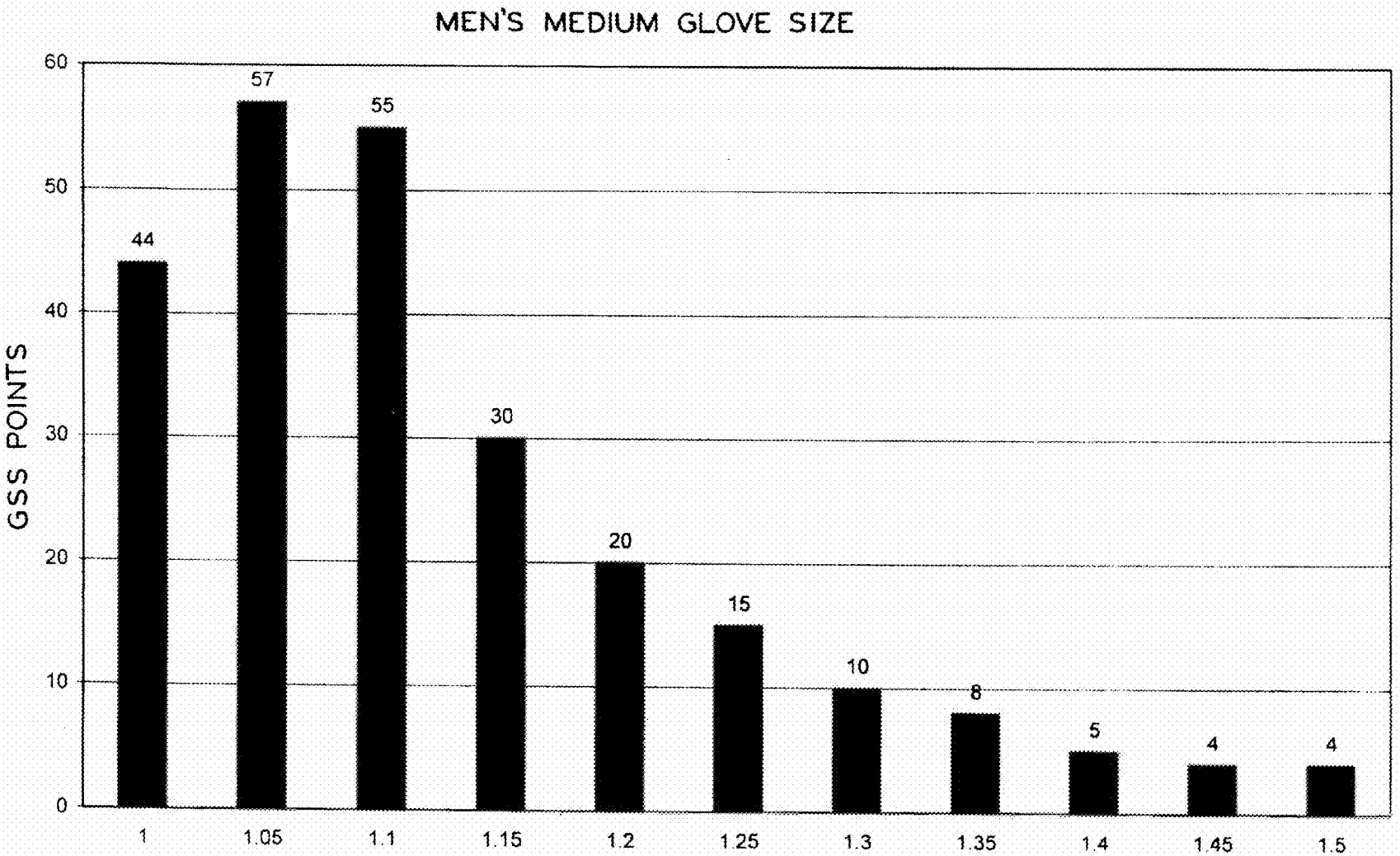
FIG. 20 is a graph of golfer satisfactions scores correlated to golfer's wearing a medium men's golf glove size.
Figure 21:
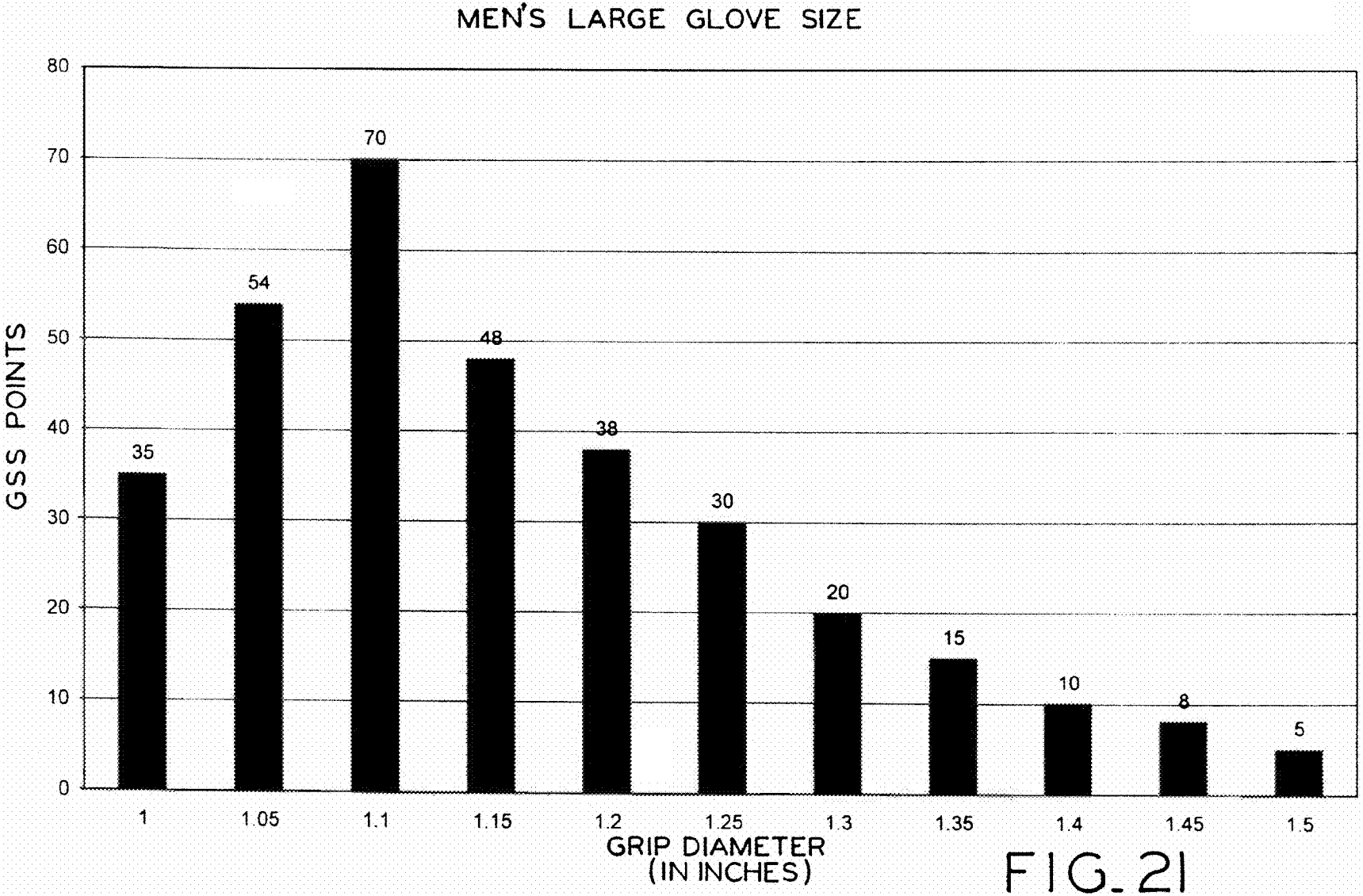
FIG. 21 is a graph of golfer satisfactions scores correlated to golfer's wearing a large men's golf glove size.
Figure 22:
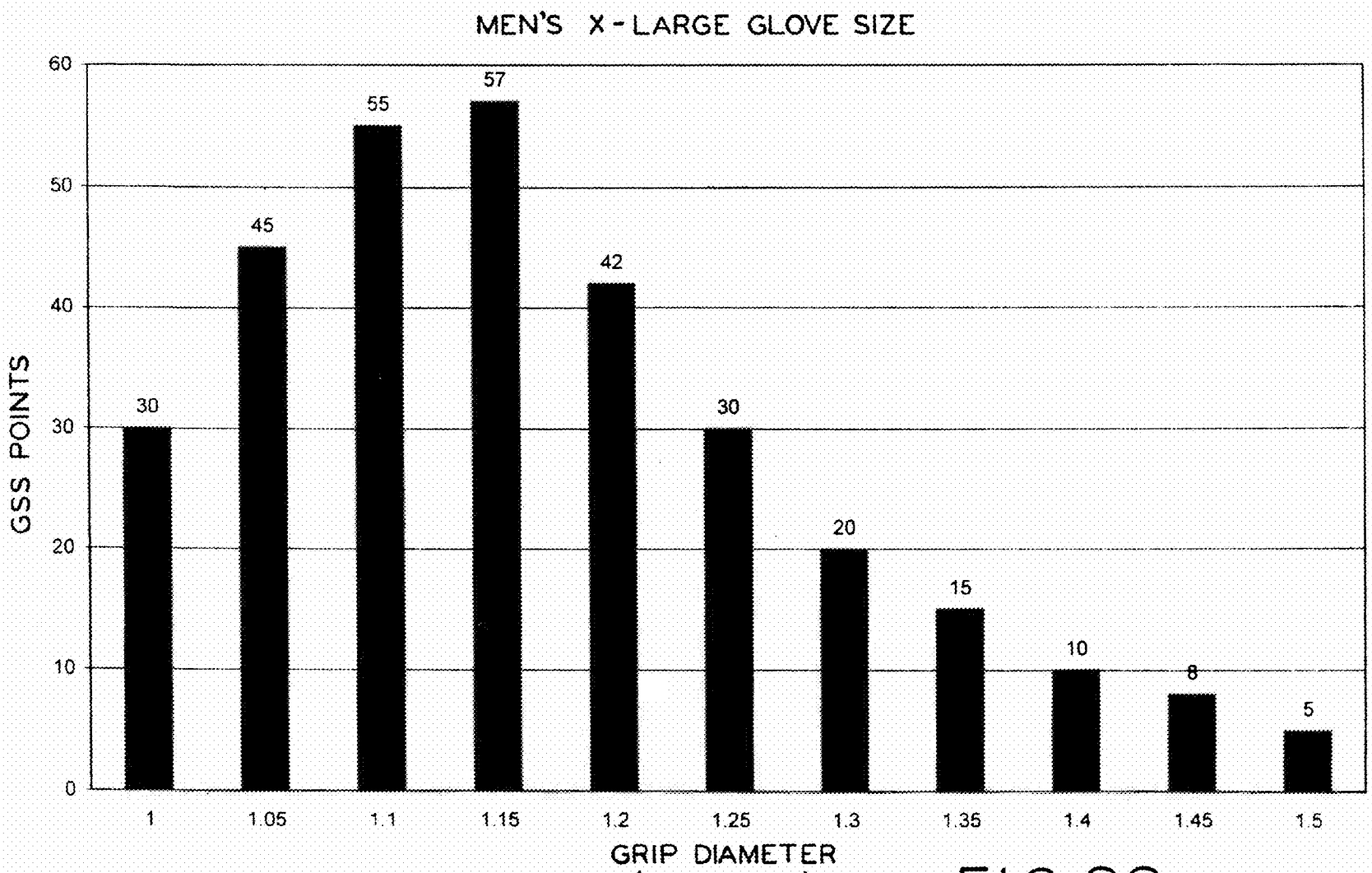
FIG. 22 is a graph of golfer satisfactions scores correlated to golfer's wearing a extra-large men's golf glove size.
Figure 23:
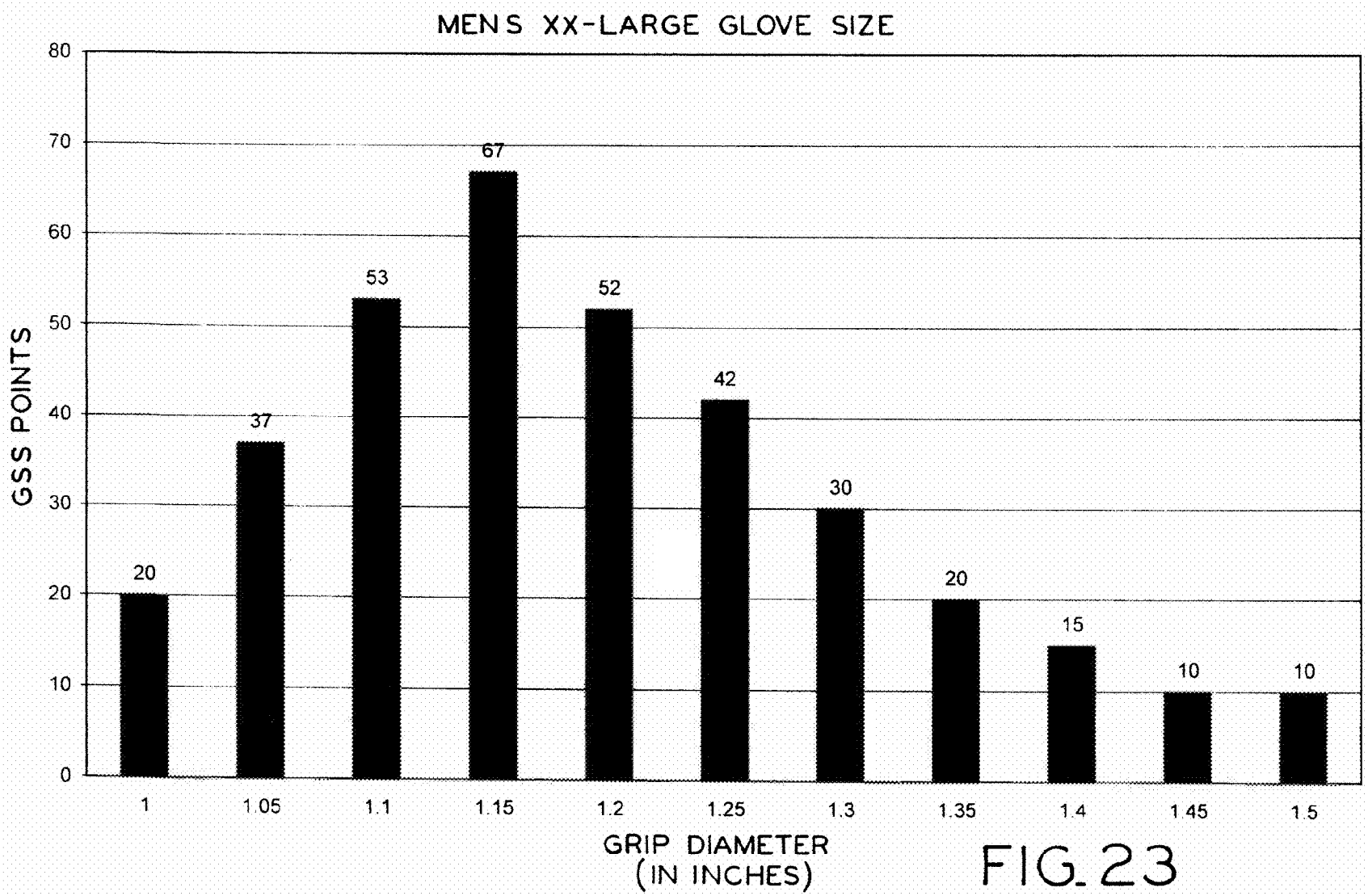
FIG. 23 is a graph of golfer satisfactions scores correlated to golfer's wearing a extra-extra-large men's golf glove size.
Figure 24:
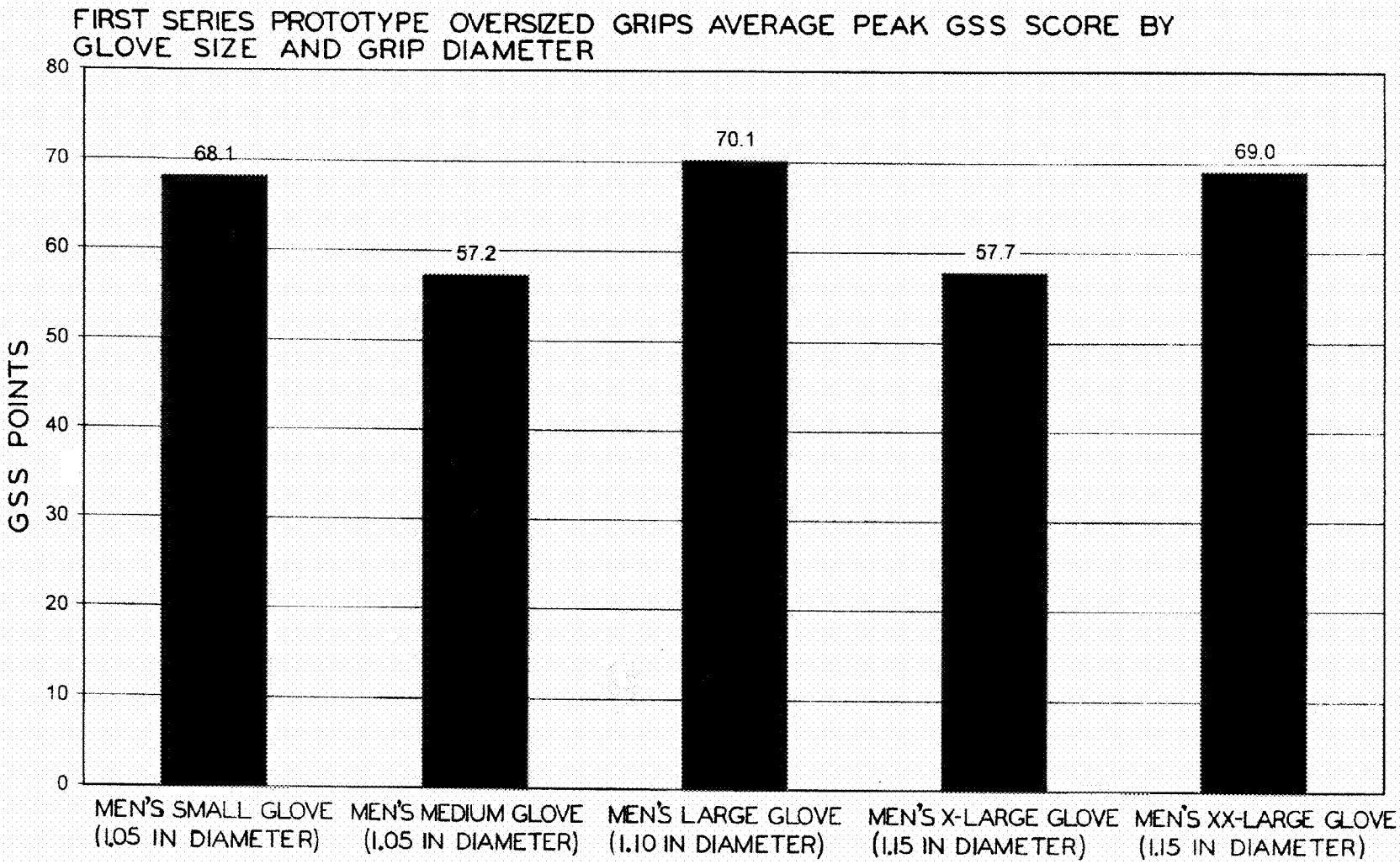
FIG. 24 is a graph of golfer satisfactions scores correlated to the men's golf glove size of the individual golfer.

Initial test results concluded that oversized grips with diameters ranging from 1.00 inches to 1.20 inches produced the best golfer satisfaction scores, as shown in FIG. 18. Oversized golf grips with diameters larger than 1.2 inches produced poor results and were therefore eliminated from any further testing. Additionally, the initial test series showed that within the 1.0 inch to 1.2 inch golf grip diameter range, golfers with small hand sizes produced their best golfer satisfaction scores when using grips with small diameters, as shown in FIG. 19. Similarly, golfers with larger hand sizes produced their best golfer satisfaction scores when utilizing grips with larger diameters, as shown in FIGS. 20-23. Additionally, golfers that wore men's golf glove sizes small, large, and extra-extra large had the highest average golfer satisfaction scores, as shown in FIG. 24. Alternatively, as shown in FIG. 24, golfers that wore men's golf glove sizes of medium and extra large had slightly lower average golfer satisfaction scores.

The initial test concluded that it was essential to properly match the size of the oversized grips to the size of the golfer's hand to maximize golf shot results. Additionally, it was also determined that prototype grips should be manufactured having smaller diameter differences between each grip size.

Example 2

Test Results Utilizing Three Different Diameters of Oversized Grips by Individual Golfers The purpose of this testing was to determine the effects of variations in golf grip diameter on in individual's golf shots. The grip size recommendation chart, as shown in Table 1 above, was used as a primary sizing reference for the test. Each individual golfer was required to perform three series of shots and there was a total of 50 shots in each series. The first series was conducted with the golfers utilizing a golf club grip having the proper grip diameter as recommended by the grip size recommendation chart of Table 1 above. The second series was performed with the golfers utilizing a grip having a grip diameter that was one size smaller than the grip size recommendation chart's recommended grip diameter and the third series was performed with golfers using a grip having a grip diameter that was one size larger than the grip size recommendation chart's recommended grip diameter. Each shot was scored using the scoring system described in detail above.

Figure 25:
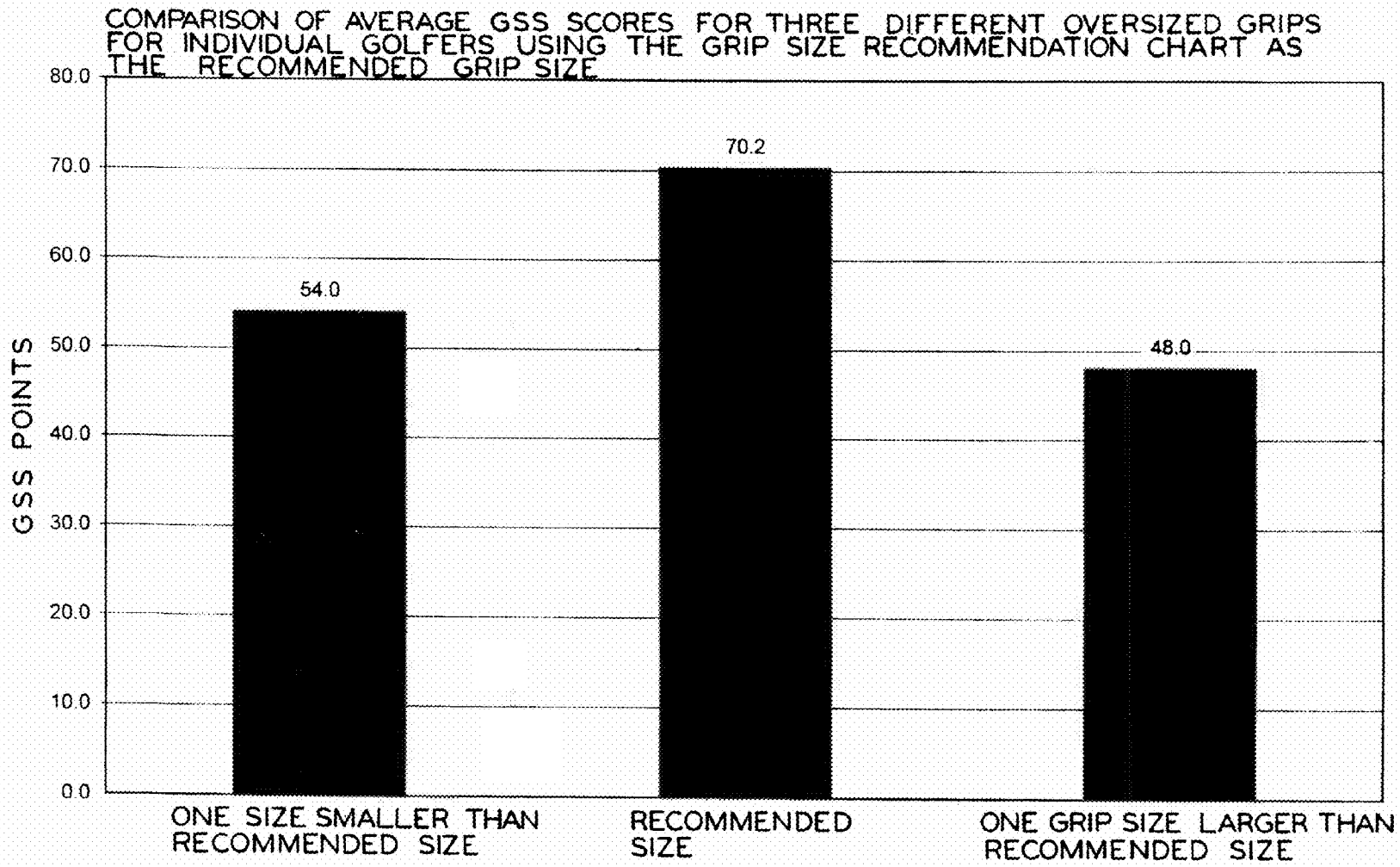
FIG. 25 is a graph of golfer satisfactions scores correlated to golfer's recommended golf grip size, a size one greater than the recommended size, and a size one lower than the recommended size.

Referring to FIG. 25, shots performed in the first series, i.e., the series utilizing the grip diameter recommended by the grip size recommendation chart, had an average golfer satisfaction score of 70.2. In contrast, shots performed in the second series, i.e., the series utilizing a grip diameter that is one size smaller than the grip diameter recommended by the grip size recommendation chart, produced an average golfer satisfaction score of 54.0. Similarly, shots from the third series, i.e., the series utilizing a grip diameter that is one size larger than the grip diameter recommended by the grip size recommendation chart, produced an average golfer satisfaction score of 48.0. Thus, scores from the first series were 16.2 points higher than scores from the second series, which represents a performance in the first series that was 30% better than the performance in the second series. Similarly, scores from the first series were 24.2 points higher than scores from the third series, which represents the first series scores being 46% better than scores from the third series.

The resultant drop off in shot performance, as indicated by the golfer satisfaction score in the second and third series, was greater than would have been originally anticipated. The difference in the diameter between consecutive grip sizes recommended by the grip size recommendation chart are 0.03 inches, which is closely equivalent to the thickness of an average credit card. Deviation from the grip size recommendation chart by one grip size resulted in significantly reduced results. Based on the results, this test validates the necessity to provide an oversized grip system having several grip sizes with diameters within a very specific diameter range. Each specific grip diameter should be correctly matched to the size of an individual golfer's hand in order for the oversized grip system to allow the golfer to produce the highest quality of golf shots.

Example 3

Comparative Testing of the Baseball Style Grasping Method and the DRP Grasping Method In order to determine whether the DRP gripping method provided a beneficial improvement over the baseball style gripping method when utilizing oversized golf club grips, testing was performed. During the testing, each golfer used an oversized grip as recommended by the grip size recommendation chart of Table 1 above. Each golfer was required to hit a minimum of 50 shots using the baseball style gripping method and 50 shots using the DRP gripping method. All shots were scored by the golfer using a golfer satisfaction score in a similar manner as set forth in detail above. The golfer satisfaction scores for each shot were then recorded.

Figure 26:
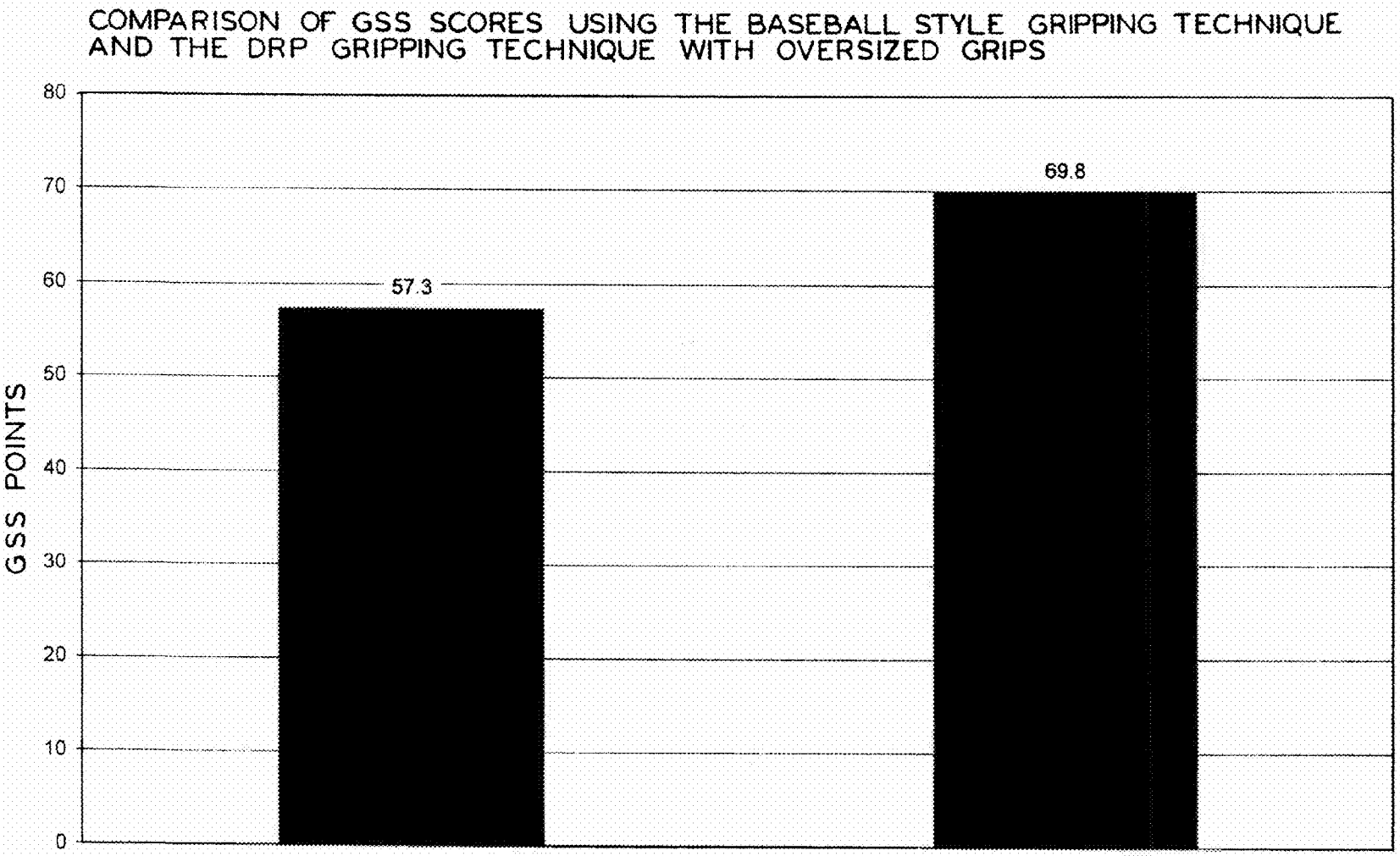
FIG. 26 is a graph of golfer satisfactions scores correlated to golfers using the baseball style gripping method and the Diagonal Rotational Power gripping method.

Referring to FIG. 26, golf shots executed using the baseball style grasping method had an average golfer satisfaction score of 57.3. In contrast, golf shots executed using the DRP grasping method had an average golfer satisfaction score of 69.8.

Thus, the DRP grasping method had an average golfer satisfaction score that was 12.5 points higher than the average baseball style grasping method score. This resulted in a 22% improvement in shot quality and performance. It is believed that the beneficial results occurred because the DRP grasping method allows for the wrist of the lower hand to pass through the impact area in a more neutral position relative to the baseball style gripping method and assists golfers in squaring the club face at impact with a greater consistency. This allows a golfer to properly square the club face at impact on a more consistent basis than is possible using the baseball style gripping method of grasping a golf club.

Example 4

Comparative Testing of Standard Size Golf Club Grips Utilizing the Vardon Gripping Method Versus the Oversized Golf Club Grip System Using the DRP Gripping Method This test was designed to compare golf shots made using standard grip diameter golf club grips and the Vardon gripping method to golf shots made using oversized grip diameter golf club grips and the DRP gripping method. For each test, golfers were required to execute a minimum of 50 shots using standard grip diameter golf club grips and the Vardon gripping method and a minimum of 50 shots using oversized grip diameter grips and the DRP gripping method. After each golf shot, the individual golfer rated the shot using a golfer satisfaction score system in the manner set forth in detail above.

Golf shots performed by golfers using standard grip diameter golf club grips and the Vardon gripping method resulted in an average golfer satisfaction score of 46.1. In contrast, golf shots performed with the golfers using the oversized grip diameter grips and the DRP gripping method resulted in an average golfer satisfaction score of 69.8. Thus, oversized grip scores using the DRP gripping method were 23.7 points higher than golfer satisfaction scores using standard golf grips and the Vardon gripping method. This equates to a 51.4% increase in golfer satisfaction, utilizing the DRP gripping method and oversized golf grips.

Example 5

Golf Club Grip Elastic Deformation Testing

Testing was conducted to determine the elastic deformation of golf grips made in accordance with the present invention, as well as standard golf grips. Each grip to be tested was installed on a True Temper® DYNAMIC GOLD® golf shaft. True Temper® and DYNAMIC GOLD® are registered trademarks of True Temper Sports, Inc. of Memphis, Tenn. The grips were installed on the golf shafts utilizing one layer of two inch wide grip tape. commercially available as Product No. 902B from Golf Smith, Inc. Standard grip installation techniques were then utilized to secure the grips in position. Once the grips were positioned and installed on the shafts, they were allowed to dry and set up for a minimum of 48 hours.

Figure 27:
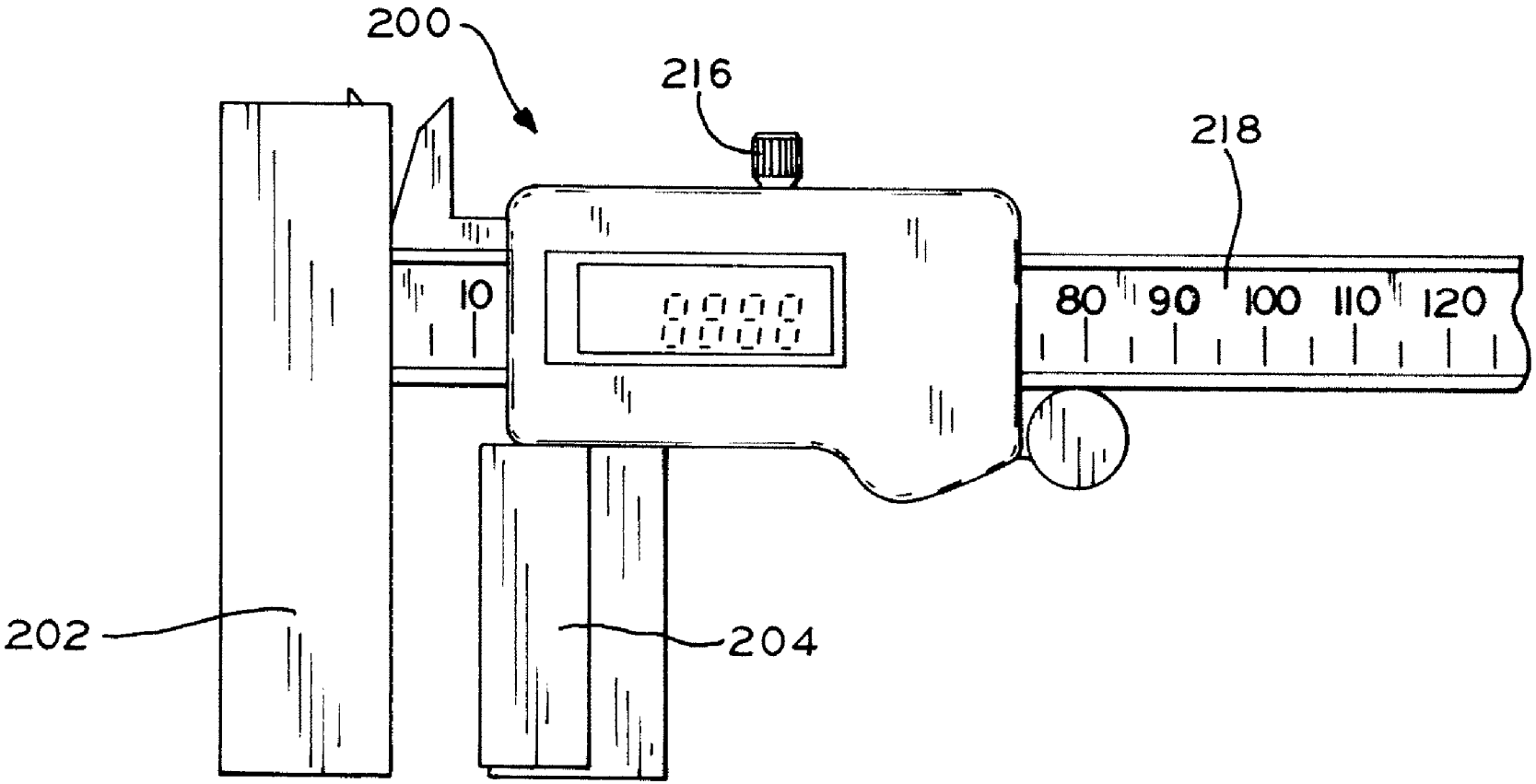
FIG. 27 is a partial plan view of the testing apparatus for elastic deformation testing.
Figure 28:
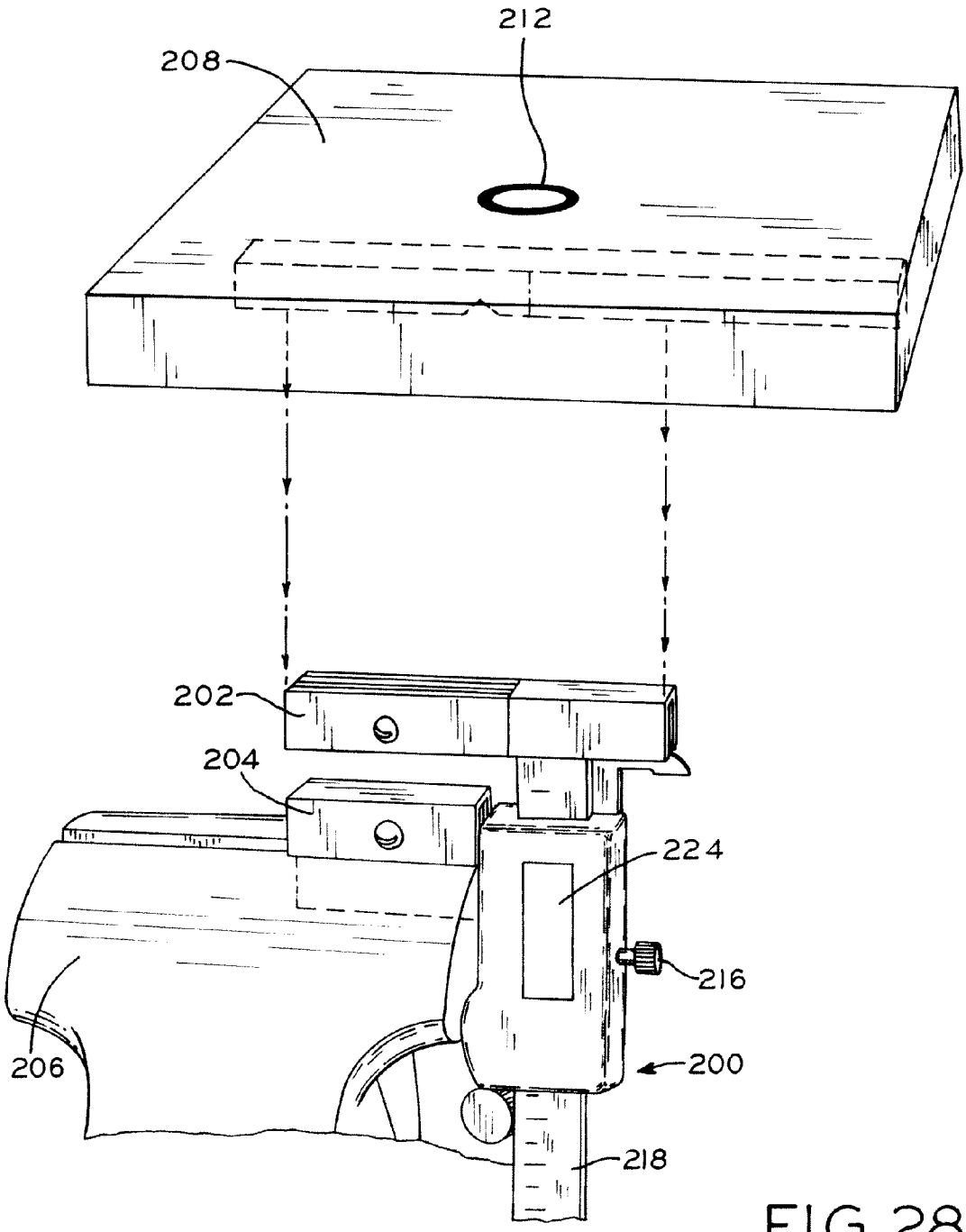
FIGS. 28-31 are partial perspective views of the testing apparatus for elastic deformation testing.

In order to measure the elastic deformation of each of the competing grips, a compression vice system was designed and built. The compression vice system utilizes a Jason Tools Electronic Digital Caliper, Model No. MT01013, commercially available from Jason International Trading Ltd. of Hong Kong. As shown in FIG. 27, digital caliper 200 includes upper and lower clamp jaws (not shown) that were rigidly secured to upper and lower jaw clamps 202, 204. Upper and lower jaw clamps 202, 204 are formed from $\frac{1}{8}^{th}$ inch by 0.75 inch aluminum bar stock having a width of 0.52 inches that defined the contact surface for the golf club grip and shaft, as described below. Referring to FIG. 28, once upper and lower jaws of digital caliper 200 were secured to jaw clamps 202, 204, the lower jaw clamp 204 was positioned within bench top vice 206, as shown in FIG. 28, and vice 206 tightened, so that lower jaw clamp 204 was fixed to bench vice 206.

Referring to FIGS. 28-31, platform 208, formed as a 5¾ inches by 5¾ inches square, was configured to be placed atop upper jaw clamp 202. Platform 208 further included a 5½ inch piece of ⅜ inch channel trim affixed to the bottom thereof by wood screws, nuts, and washers, as shown in dashed lines in FIG. 28. Centerline mark 210 (FIG. 29) was formed in the channel trim to ensure that the platform could be repeatedly placed over upper jaw clamp 202 of digital caliper 200 to provide a consistent downward vertical compressive load on the various golf grips being tested. Additionally, as shown in FIG. 28, on the opposing side of platform 208, circle 212 was made to ensure that weights could be positioned at the exact center of platform 208.

Figure 29:
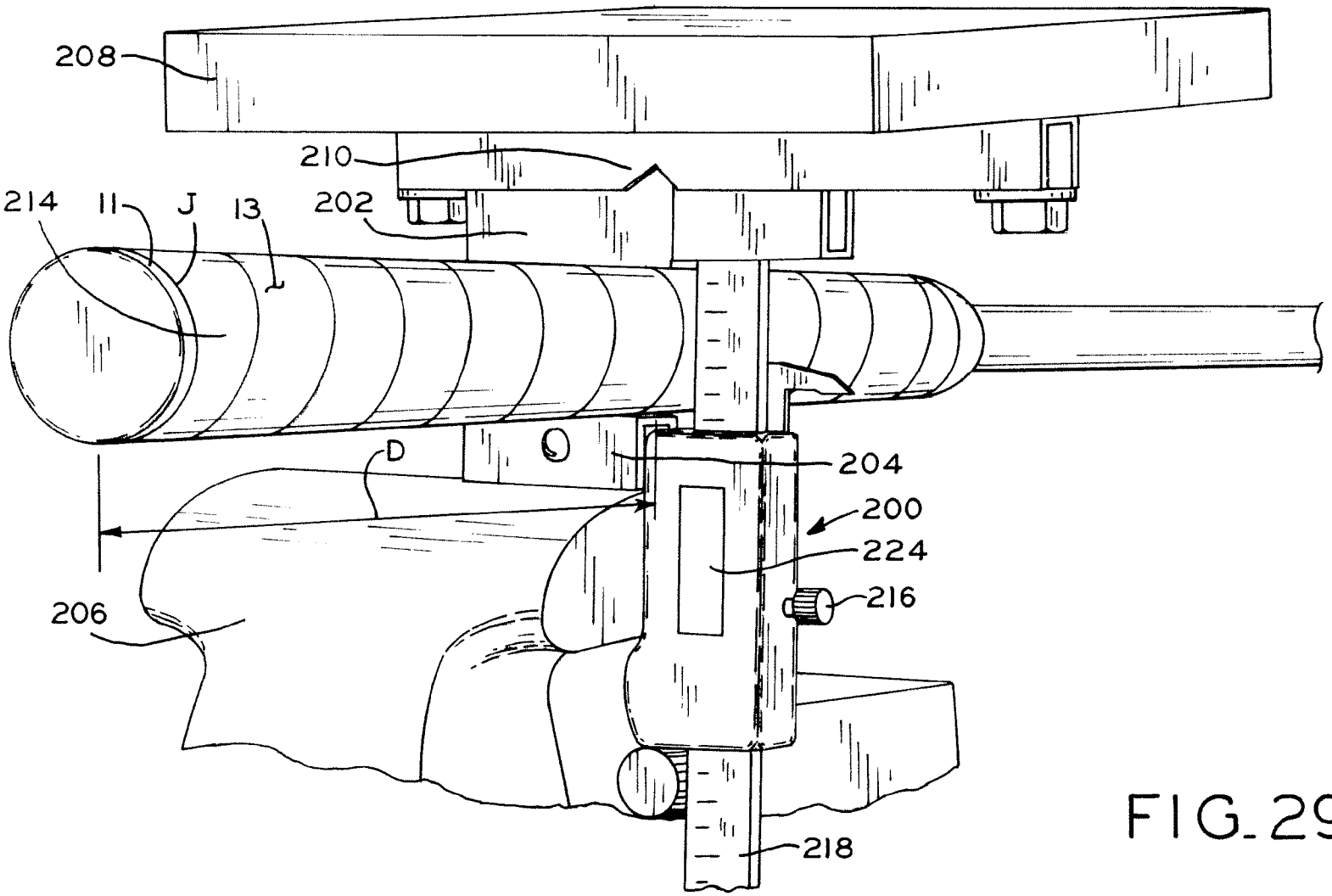

Referring to FIG. 29. once properly positioned, golf club grip 214. the grip to be tested. was placed in the opening between the upper and lower clamp jaws 202, 204 fixed to digital caliper 200. Golf club grip 214 was aligned so that a location spaced distance D, which was six inches from junction J defined between cap end 11 and gripping surface 13 of the golf grip as shown in FIG. 29 or about 158 mm from the proximal end of the golf club grip defined by cap end 11, was centered on lower clamp jaw 204 and the longitudinal axis of the grip was positioned perpendicular to the long axis of lower jaw clamp 204 of digital caliper 200. Set screw 216, which securely locks slide 218 of digital caliper 200 in position, was then loosened, allowing slide 218 to move freely.

Figure 30:
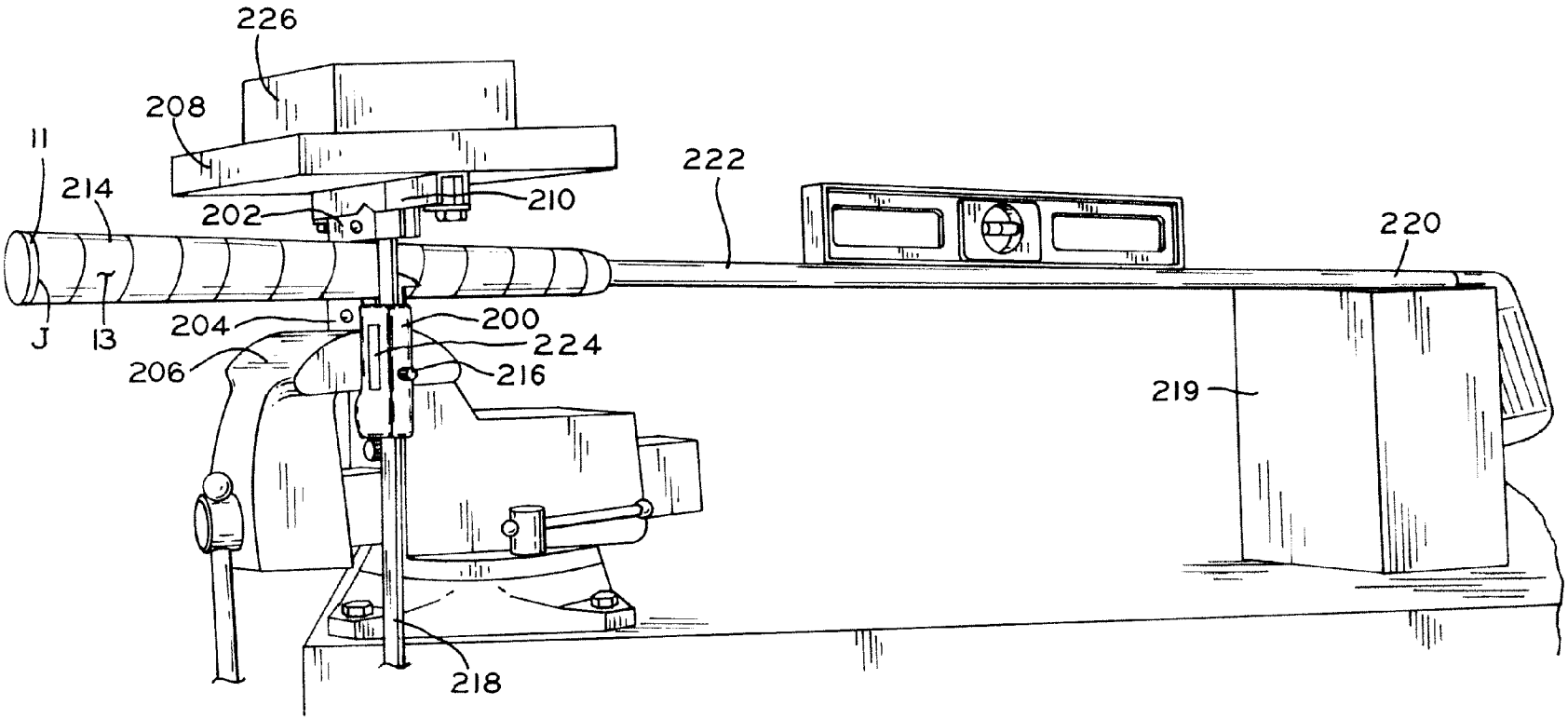
Figure 31:
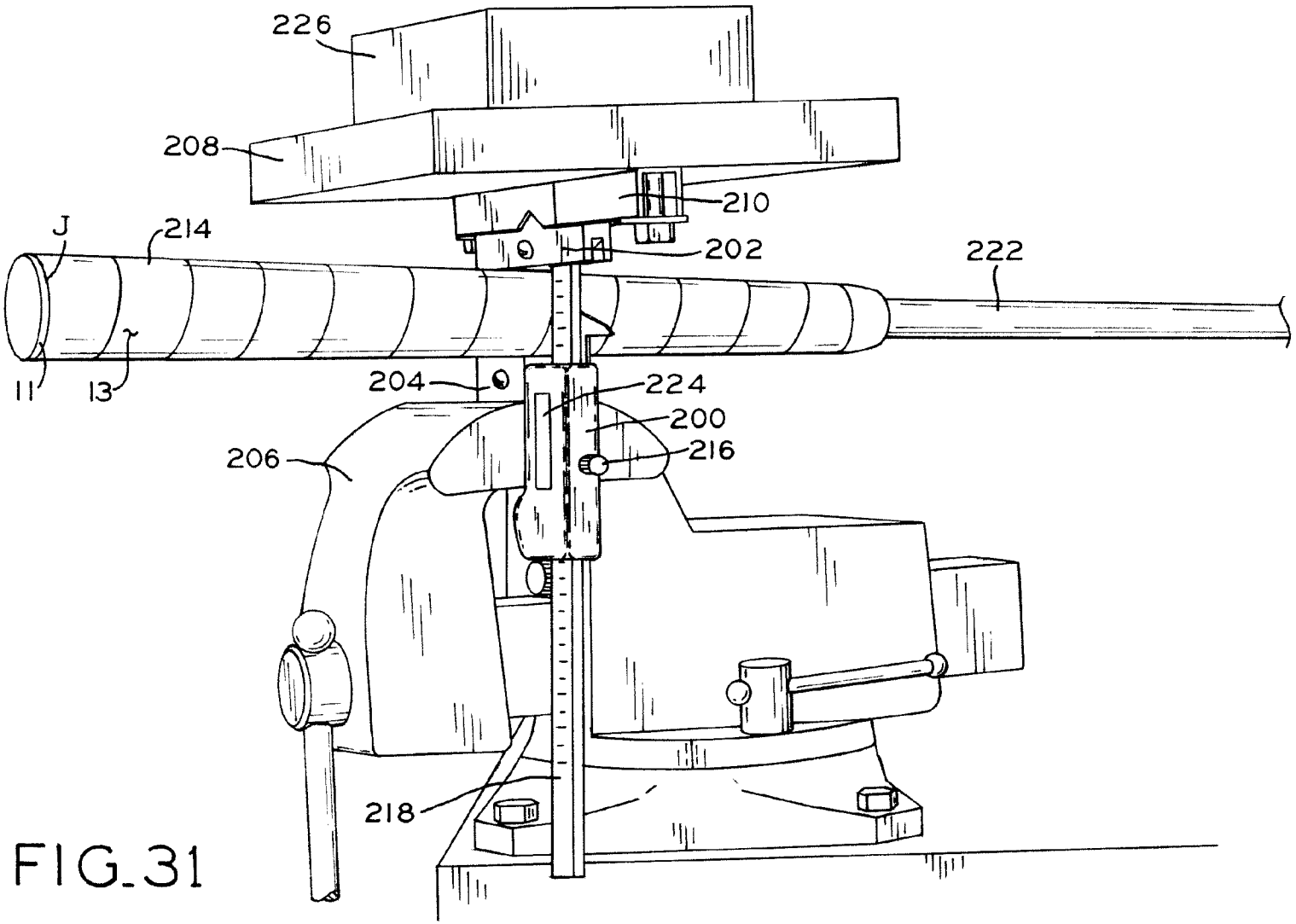

Once in this position, wooden blocks 219, as shown in FIG. 30, were placed under club head end 220 of golf shaft 222 with the toe of the club pointing down. Blocks 219 were sized so that shaft 222 was positioned parallel to lower clamp jaw 204. With grip 214 positioned between upper and lower clamp jaws 202, 204, platform 208 was gently lowered onto the top edge of upper clamp jaw 202 and caliper reading scale 224 was reset to 0.000 inches. As shown in FIGS. 30 and 31, two 2½ pound weights 226 were lowered and centered on top of wooden platform 208. Digital caliper 200 was than read and the amount of elastic deformation of the grip, which corresponds to the reading displayed on digital caliper 200, was recorded. Two 5 pound weights were then placed and centered on top of the two 2½ pound weights 226. Caliper reading scale 224 was than read and the amount of elastic deformation of the grip recorded. The results of the testing are set forth below in Table 8, which provides readings of elastic deformation on both the 5 lb. load and the 15 lb. load, as described in detail above.

Based on the results as shown in Table 8, it was determined that a grip, in order to compress a reasonable amount under low hand pressure for an arthritic golfer while, at the same time, not over compressing when firmer hand pressure is applied, needs to elastically deform at least 1.0 mm and no more than 2.0 mm under 5 lbs. of vertical compressive force. Similarly, under 15 lbs. of vertical compressive force, the grip should deform no less than 1.5 mm and no more than 3.0 mm.

TABLE 8

Elastic Deformation of Golf Club Grills From Various Manufacturers Subjected To Vertical Compressive Loads

| Manufacturer | Brand | Grip Size | 5 lb. Load Elastic Deformation | | 15 lb. Load Elastic Deformation |
|---|---|---|---|---|---|
| Avon | Chamois | Jumbo | 1.245 | mm | 2.286 mm |
| Tacki-Mac | Arthritic | +3/32 in. | 1.435 | mm | 2.360 mm |
| Lamkin | Perma-Wrap | Standard | 1.330 | mm | 1.880 mm |
| Winn | G 8 | Standard | 1.511 | mm | 2.030 mm |
| Winn | MasterWrap | Standard | 2.197 | mm | 3.290 mm |
| Golf Pride | Full Cord | Standard | .9144 | mm | 1.322 mm |
| Golf Pride | DD 2 | Standard | .9650 | mm | 1.400 mm |
| Lamkin | Crossline | +1/16 in. | 1.143 | mm | 1.880 mm |
| Winn | Xi7 | +1/8 in. | 1.839 | mm | 2.590 mm |
| Tour Edge | Tour Edge | Standard | .9020 | mm | 1.570 mm |
| Lamkin | Torsion Control | +1/8 in. | .8255 | mm | 1.397 mm |
| Lamkin | Torsion Control Tour Series | +1/8 in. | .9144 | mm | 1.473 mm |
| Golf Club Grips Made in Accordance With an Exemplary Embodiment of the Present Invention | | 26.7 mm (pre-installation) | 1.230 | mm | 1.765 mm |
| | | 27.7 mm (pre-installation) | 1.372 | mm | 2.110 mm |
| | | 28.7 mm (pre-installation) | 1.816 | mm | 2.590 mm |

Example 6

Grip Torsion Testing Method and Apparatus

Testing was conducted to determine the torsion experienced by golf grips made in accordance with the present invention, as well as standard golf grips. Each grip to be tested was installed on a True Temper® DYNAMIC GOLD® golf shaft. True Temper® and DYNAMIC GOLD® are registered trademarks of True Temper Sports, Inc. of Memphis, Tenn. The grips were installed on the golf shafts utilizing one layer of two inch wide grip tape, commercially available as Product No. 902B from Golf Smith, Inc. Standard grip installation techniques were then utilized to secure the grips in position. Once the grips were positioned and installed on the shafts, they were allowed to dry and set up for a minimum of 48 hours.

Figure 32:
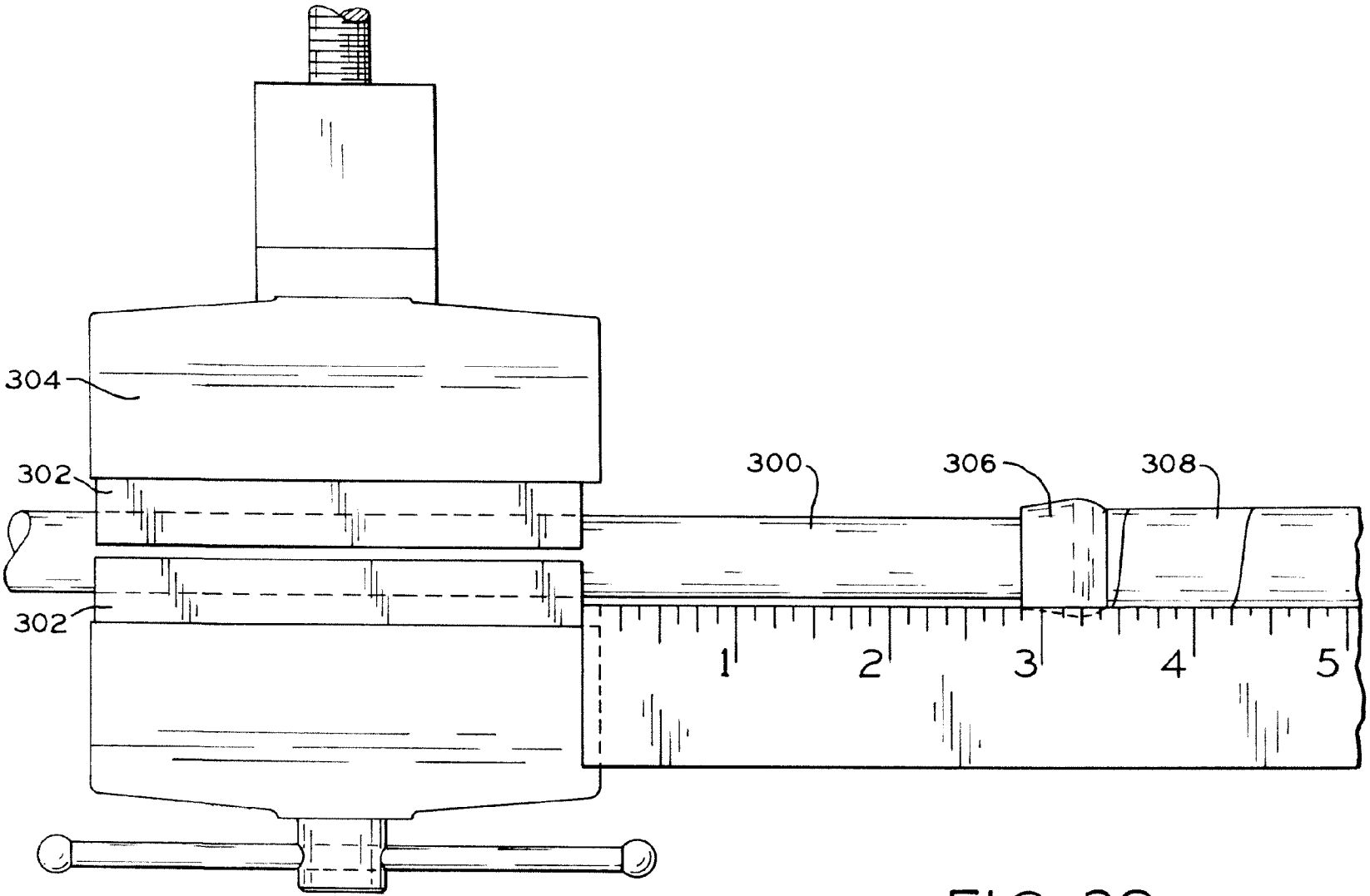
FIG. 32 is a partial plan view of the testing apparatus for degree of torsion testing.
Figure 33:
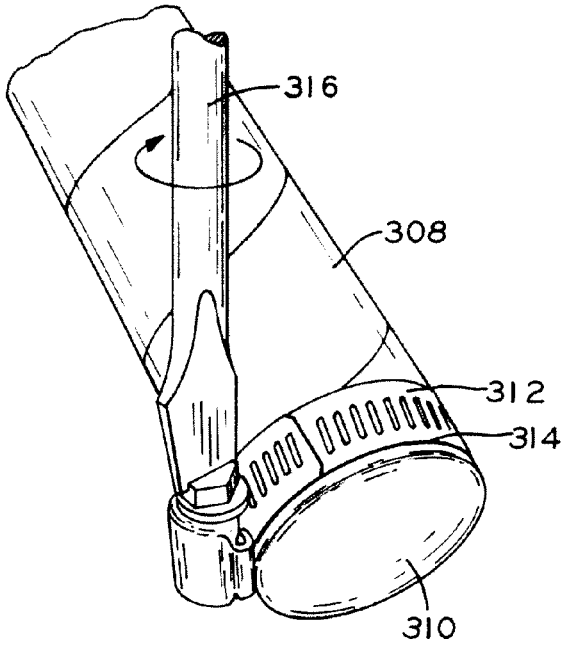
FIGS. 33-35 are perspective views of the testing apparatus for degree of torsion testing.
Figure 34:
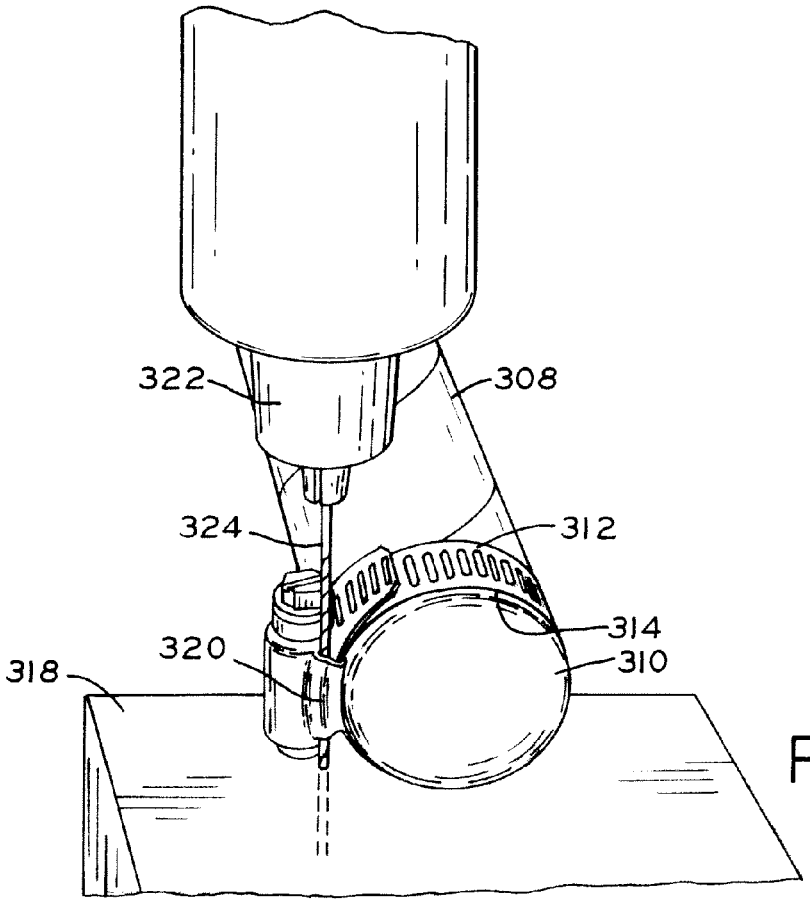
Figure 35:
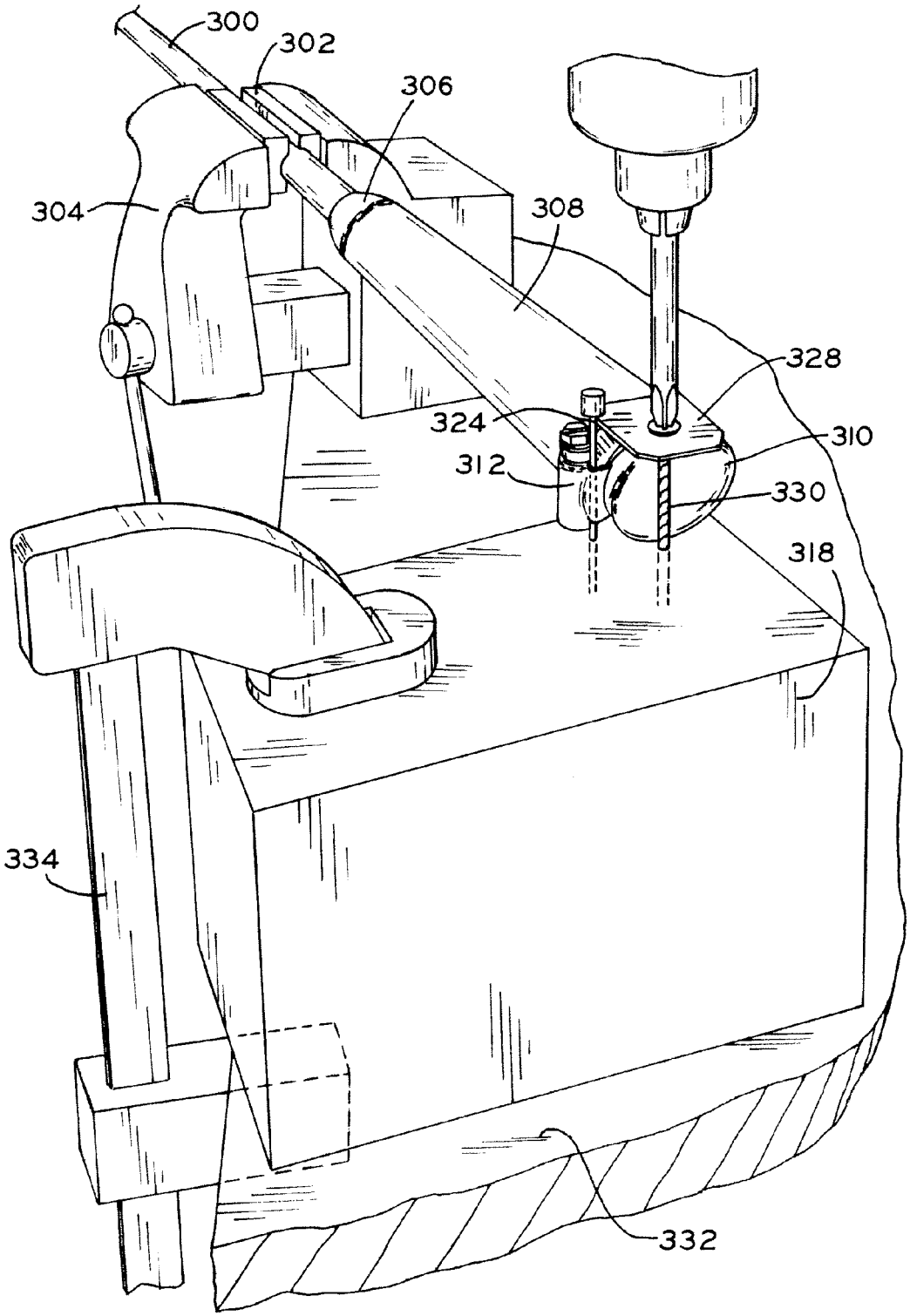

Referring to FIG. 32, each golf shaft was tested by first placing shaft 300 within vinyl rubber vice clamp 302, commercially available from Golfsmith as Product No. 913. Vinyl rubber vice clamp 302 is designed for use with golf shafts 300 and includes an opening in the center thereof having a substantially circular longitudinal cross-section that conforms to the cross-section of shaft 300. The outer portions of rubber vice clamp 302 has substantially flat sides that provide for a large contact area with bench mounted vice 304. Vinyl rubber vice clamp 302 was positioned three inches from distal end 306 of grip 308. Proximal end 310 of grip 308 was secured by hose clamp 312, as shown in FIGS. 33-35, so that first edge 314 of clamp 312 was positioned directly over junction J defined between cap end 11 and gripping surface 13 of grip 308. Hose clamp 312 was tightened around proximal end 310 of grip 308 with flat head screwdriver 316, as shown in FIG. 33.

Figure 36:
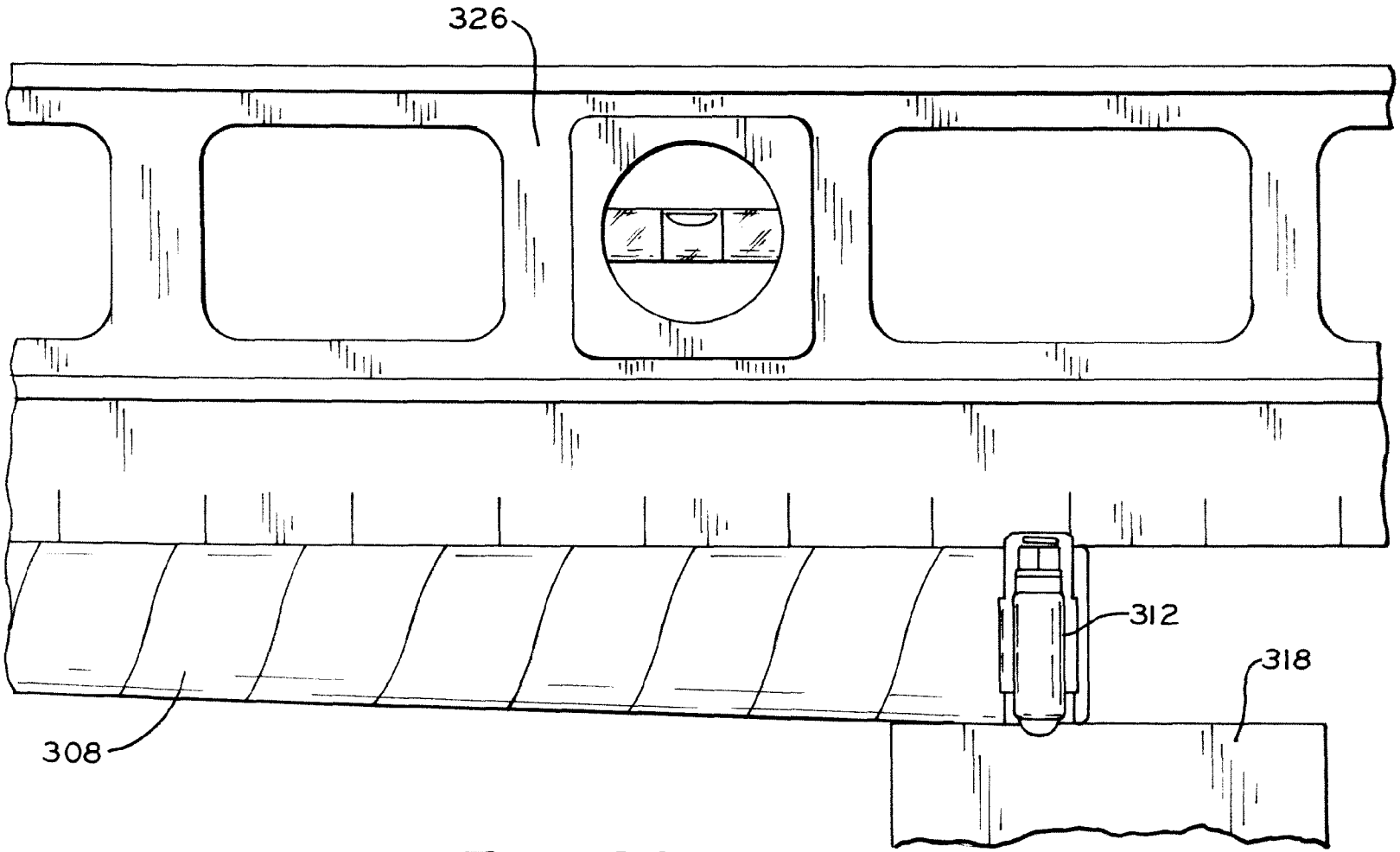
FIG. 36 is another partial plan view of the testing apparatus for degree of torsion testing.

Referring to FIG. 34, wood blocks 318 were then placed under proximal end 310 of grip 308 and an aperture was drilled through side bracket 320 of hose clamp 312 and into wood block 318. Drill chuck 322 was then loosened and the drill removed from drill bit 324, allowing drill bit 324 to function as a securement mechanism for retaining hose clamp 312 in position relative to wood block 318. The top surface of grip 308 was then placed in a horizontally level position and the position confirmed using pitch angle level 326, as shown in FIG. 36. Referring to FIG. 35, in order to provide additional fixation to proximal end 310 of grip 308, square washer 328 was placed over proximal end 310 of grip 308 and screw 330 inserted through an aperture in square washer 328. Screw 330 was then advanced into wooden block 318 to tighten square washer 328 against proximal end 310 of grip 308.

Figure 37:
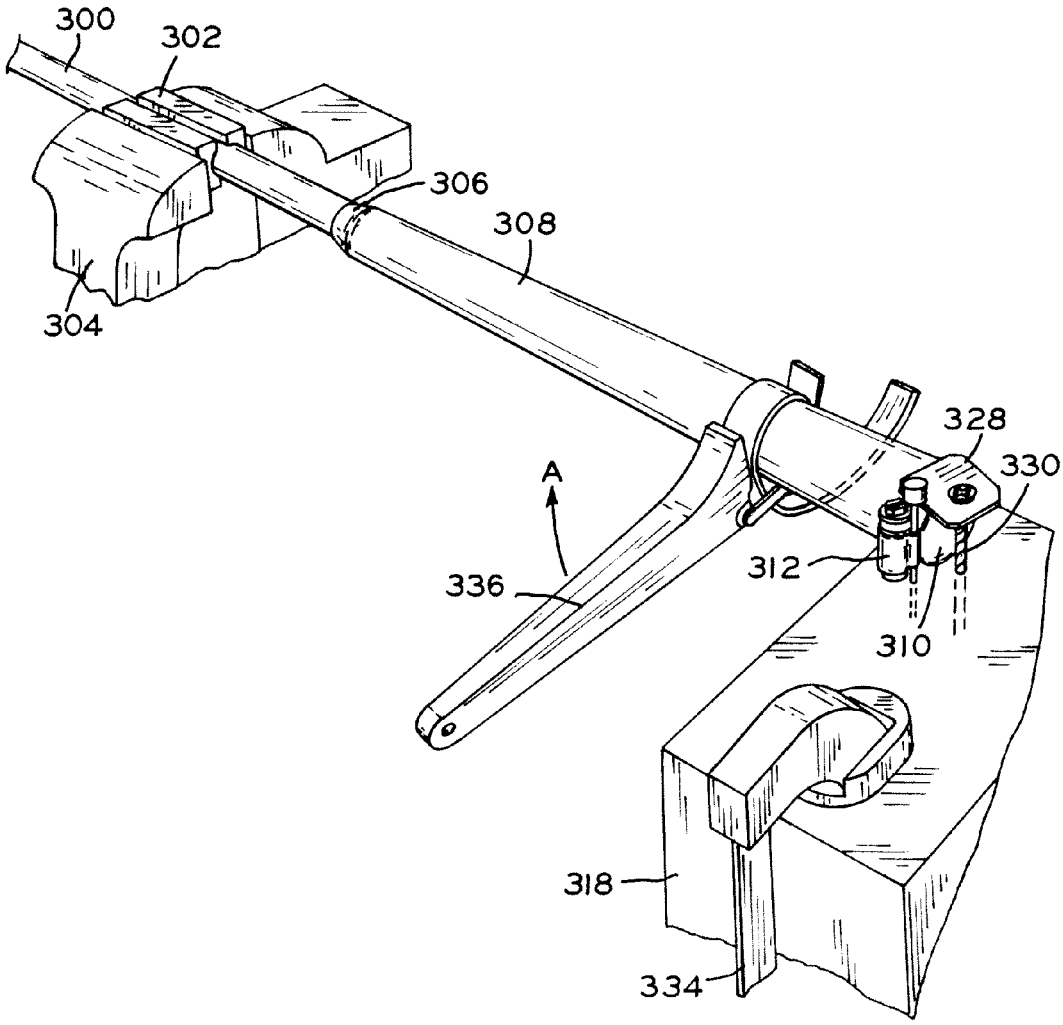
FIGS. 37-42 are additional perspective views of the testing apparatus for degree of torsion testing.
Figure 38:
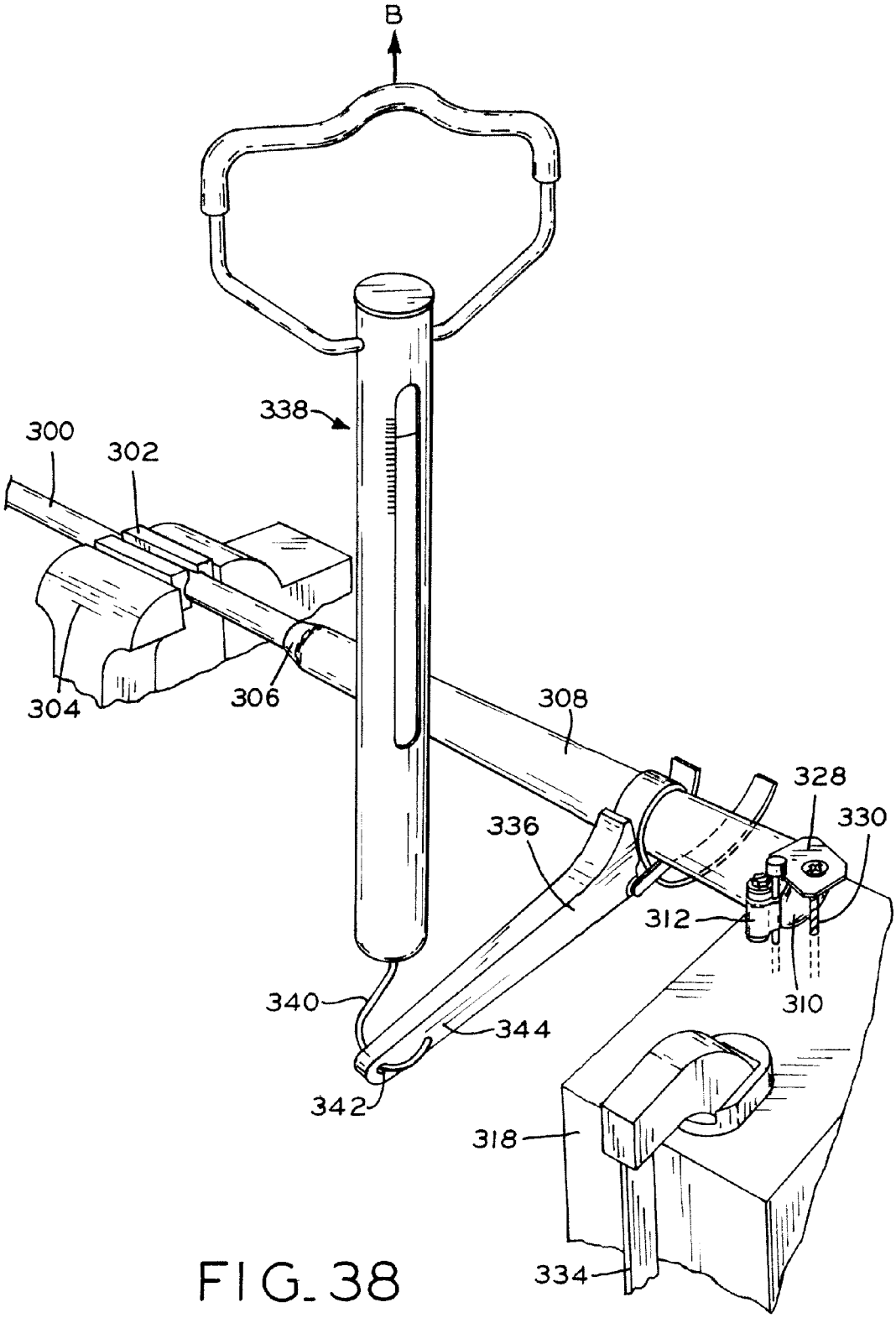
Figure 39:
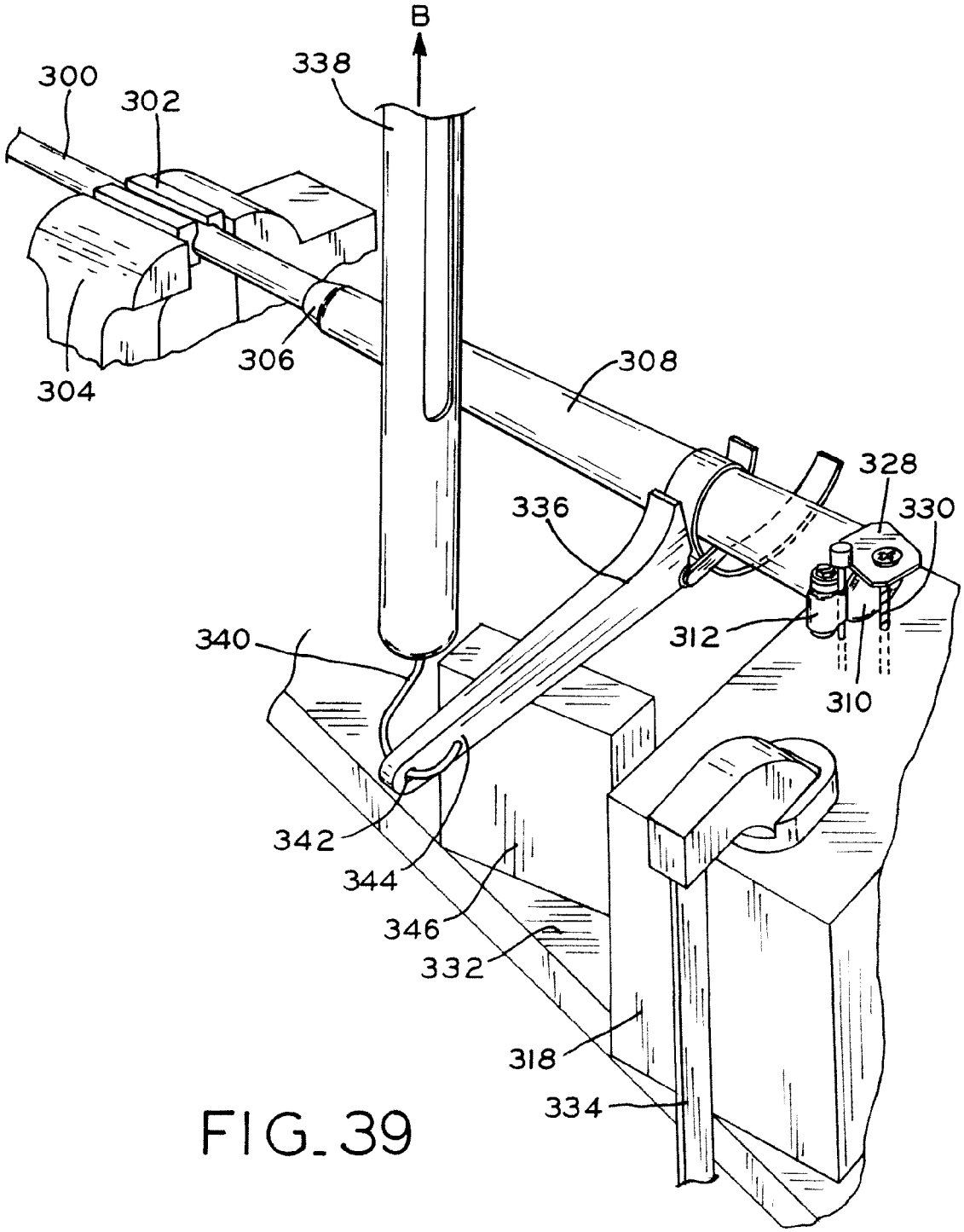

In order to ensure that wooden block 318 remained rigidly fixed atop work bench 332, shown in FIG. 35, mini bar clamp or spreader 334, such as Craftsman mini bar clamp/spreader, commercially available from Craftsman as Part No. 31669, was used to clamp wood block 318 to workbench 332. Strap wrench 336, shown in FIG. 37, was then placed around grip 308 at a location perpendicular to the long axis of grip 308 and spaced three inches from junction J defined between cap end 11 and gripping surface 13 or about 82 mm from the proximal end of the golf club grip defined by cap end 11. In this position, strap wrench 336 could be actuated in the direction of arrow A of FIG. 37 to torque grip 308 in an upward direction. Referring to FIG. 38, spring scale 338 was then connected to torque grip 308 at a distance of 150 mm from the outer surface, i.e., gripping surface 13, of the grip by placing grabbing hook 340 through aperture 342 in wrench handle 344. Referring to FIG. 39, an upward force was then applied to spring scale 338 in the direction of arrow B until 5 lbs. of force registered on spring scale 338 and strap wrench handle 344 was in a horizontal position.

Figure 40:
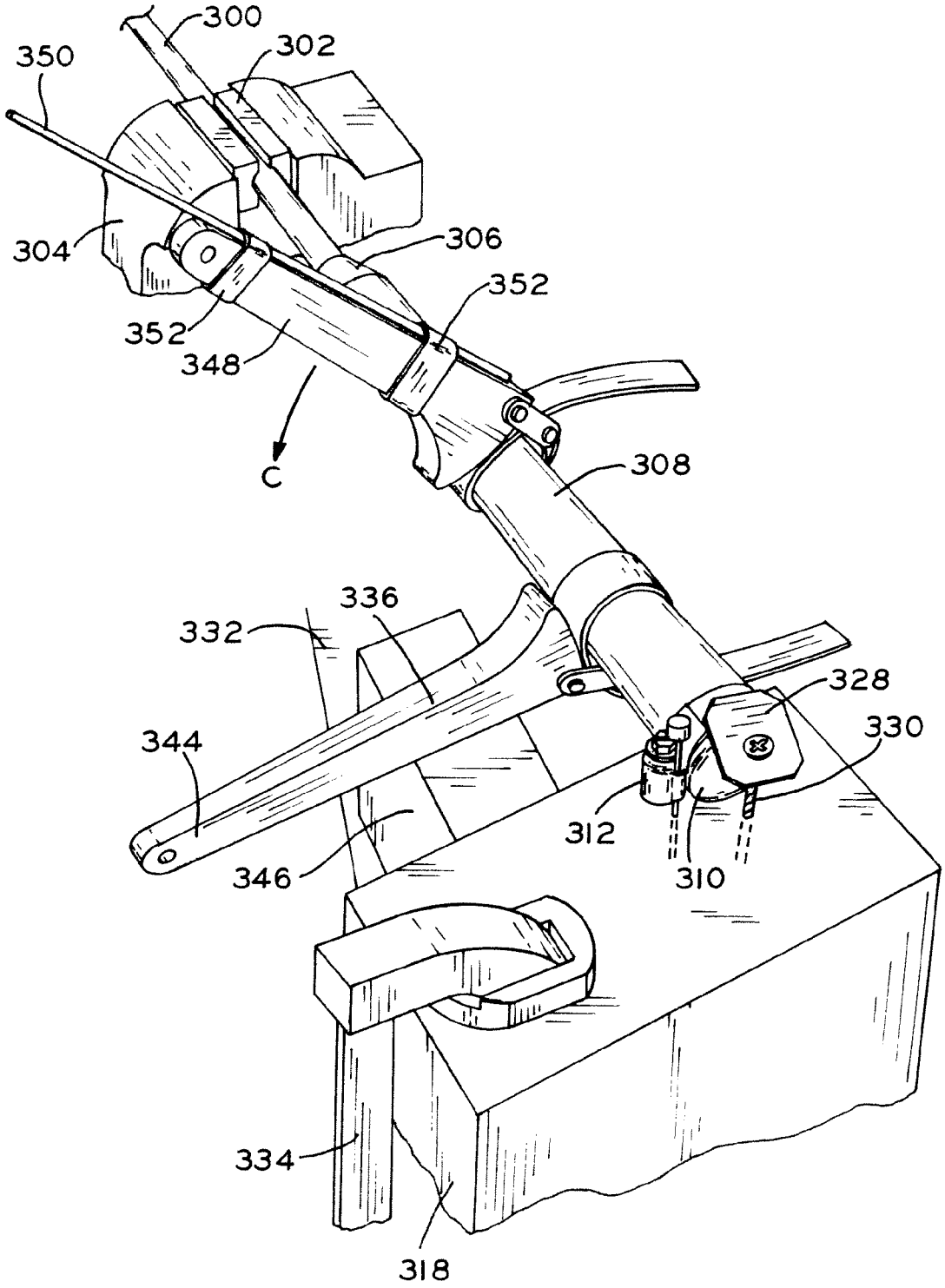

Wood block 346 was then placed between handle 344 of strap wrench 336 and the top of work bench 332 to hold strap wrench handle 344 in a substantially horizontal position. The spring scale was then removed. Second strap wrench 348 was placed around grip 308 at a location six inches from junction J defined by cap end 11 and gripping surface 13, as shown in FIG. 40, or about 158 mm from the proximal end of the grip defined by cap end 11. With strap wrench 348 in this position, strap wrench 348 could be actuated to apply torque in a downward direction, i.e., the direction of arrow C. Additionally, a section of brass tubing 350 was cut to 8.25 inches and secured to strap wrench 348 with duct tape 352.

Figure 41:
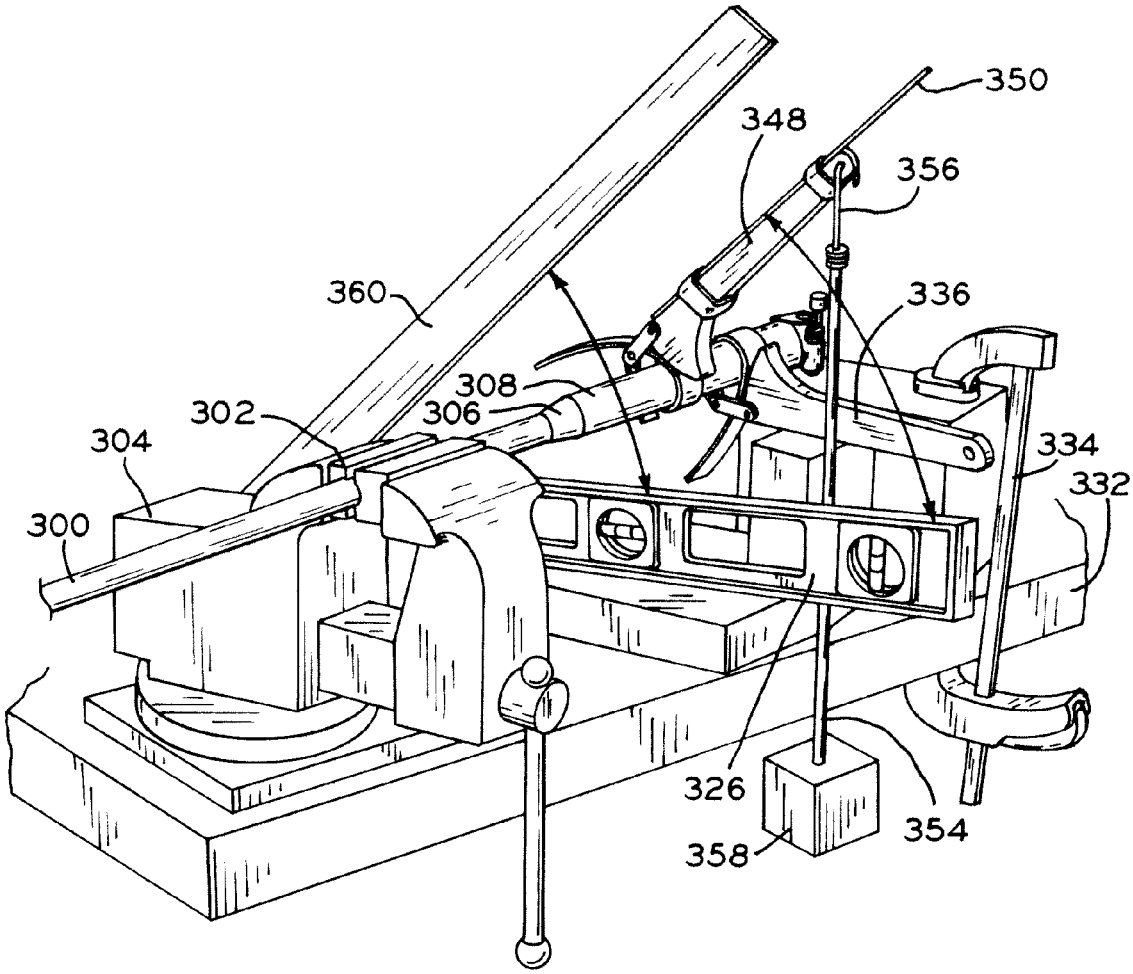
Figure 42:
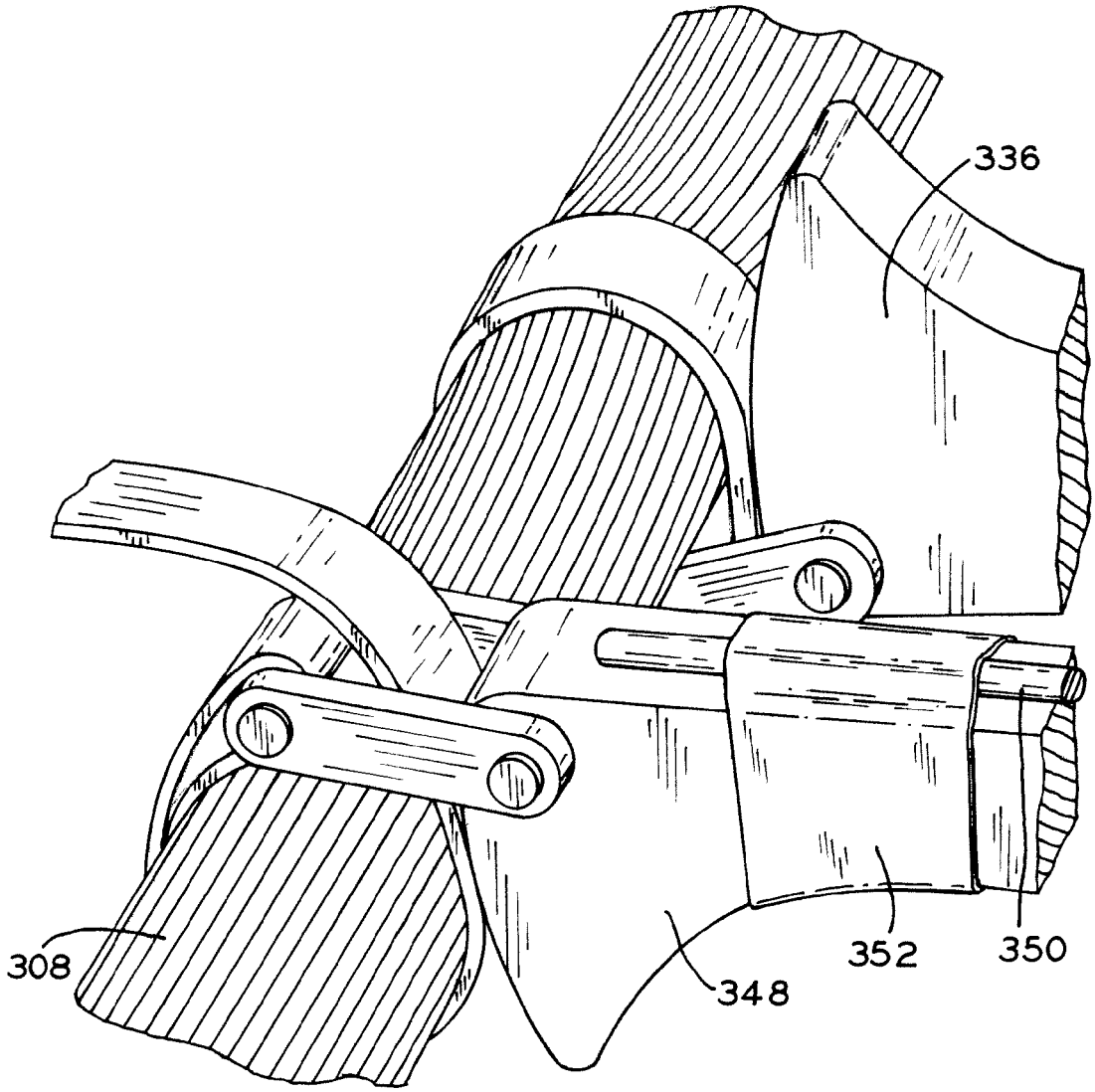

Referring to FIG. 41, 18 inch long bungee cord 354 was hooked through an opening in strap wrench 348 at a distance of 150 mm from the outer surface, i.e., gripping surface 13, of the grip. A strip of super heavy duty duct tape was wrapped around the opening in strap wrench 348 to keep hook 356 of bungee cord 354 in the outermost position of the opening, i.e., to keep hook 356 of bungee cord 354 spaced a distance of 150 mm from the gripping surface 13 of the grip. Strap wrench 348 was preloaded by hooking a ½ lb. rubber mallet 358 onto the lower bungee cord hook, as shown in FIG. 41. Brass tubing 350 was than positioned so that it rested at a 45 degree angle midway between a vertical and a horizontal plane. The 45 degree angle position of the brass tubing was checked and validated utilizing pitch angle level 326.

The initial position of the tip of brass tubing 350 was measured utilizing a carpenter's aluminum ruler 360. Constant downward tension was kept on bungee cord 354 and ½ lb. rubber mallet 358 was removed from the lower bungee cord hook. 2½ lb. rubber mallet (not shown) was then hung on the lower bungee cord hook. Aluminum ruler 360 was used to measure the location of the tip of brass tubing 350 as the handle of strap wrench 348 rotated under the gravitational force caused by the 2½ lb. rubber mallet.

The measurement of the distance that the tip of brass tubing 350 moved when the 2½ lb. rubber mallet was hung on the lower hook of bungee cord 354 was utilized to calculate the length of the arch over which the tip of brass tube 350 moved as wrench 348 was rotated. The length from the mid-line of grip 308 to the tip of brass tubing 350 formed the radius of the arc and was used to calculate the circumference of a circle that the tip of brass tube 350 would travel if actuated 360 degrees. These two measurements were used to calculate the number of degrees of torsion of the grip experience between the three inch and six inch positions, i.e., strap wrench 336 and strap wrench 348, on grip 308. The pitch angle level was used to cross-check and validate all grip torsion measurements.

The three inch and six inch positions selected for placement of strap wrenches 336, 348 were approximately positioned at the mid-line of the upper and lower hands when a golfer gripped the golf grip. This gives a reasonable approximation of the amount of torsion the golfer will experience between the shaft and the outer surface of the grip during a golf swing. Thus, if a golfer strikes the ball outside the affective sweet spot of the club face, the moment arm created between the long axis of the shaft and the point of impact with the club face with the ball will be lengthened and the grip will twist a greater amount. Grips with less resistance to torsion will be more negatively affected on the off center shots than grips with good torsion resistance.

The results of the torsion testing, set forth below in Table 9 below, indicated that golf grips should experience a minimum torsion of 5.0 degrees and a maximum torsion of 20.0 degrees. Additionally, in some grip designs, the maximum level torsion may be as low as 19.5, 19.0, 18.5, 18.0, or 17.5 degrees.

TABLE 9

Torsion Testing of Golf Grips Manufacturing According to an Exemplary Embodiment of the Present Invention and of Commercially Available Standard, Mid-Size, Over-Size, and Arthritic Golf Grips

| Manufacturer | Grip Size | Brand/Style | Torsion |
|---|---|---|---|
| Lamkin | Standard | Perma-Wrap Plus | 28.26 Degrees |
| Golfpride | Standard | Dual Durometer 2 | 27.40 Degrees |
| Tour Edge | Standard | Tour Edge | 50.62 Degrees |
| Winn | Standard | G8 | 12.17 Degrees |
| Golfpride | Standard | Tour Wrap - Full Cord | 10.20 Degrees |
| Lamkin | Midsize +1/16 | Crossline | 25.03 Degrees |
| Winn | Oversize +1/8 | Xi7 | 21.03 Degrees |
| Lamkin | Oversize +1/8 | Torsion Control | 26.11 Degrees |
| Lamkin | Oversize +1/8 | Torsion Control "Tour Series" | 27.67 Degrees |
| Chamois | +1/8 | Arthritic | 50.27 Degrees |
| Tacki-Mac | +3/32 | Arthritic | 49.89 Degrees |
| Grip Made in Accordance with an Exemplary Embodiment of the Present Invention | 26.7 mm | Medium | 13.60 Degrees |
| Grip Made in Accordance with an Exemplary Embodiment of the Present Invention | 27.7 mm | Medium/Large | 14.87 Degrees |
| Grip Made in Accordance with an Exemplary Embodiment of the Present Invention | 28.7 mm | Large | 10.44 Degrees |

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A golf club grip system, comprising: a plurality of golf club grips, each of said plurality of golf club grips having an inner layer and an outer wrap, said inner layer forming a substantially cylindrical body having an open end for receipt of a golf club shaft and a cap end, said outer wrap surrounding at least a portion of said inner layer and defining a gripping surface, each of said plurality of golf club grips having a grip diameter prior to installation on a golf club shaft defined by said gripping surface and a grip wall thickness extending radially from an inner surface of said inner layer to said gripping surface, both of said grip diameter and said grip wall thickness measured at a distance of about 158 millimeters from a proximal end of each of said plurality of golf club grips defined by said cap end of each of said plurality of golf club grips, said grip diameter being at least 3.8 times greater than said grip wall thickness and no more than 4.7 times greater than said grip wall thickness; wherein each of said plurality of golf club grips has an elastic deformation under five pounds of vertical compressive force of at least 1.0 millimeter and no more than 2.0 millimeters and an elastic deformation under fifteen pounds of vertical compressive force of at least 1.5 millimeters and no more than 3.0 millimeters.

2. The golf club grip system of claim 1, wherein said grip diameter of each of said plurality of golf club grips measured prior to installation on a golf club shaft is at least 25.4 millimeters and no more than 30.5 millimeters.

3. The golf club grip system of claim 1, wherein said plurality of golf club grips includes a first golf club grip having a first grip diameter measured prior to installation on a golf club shaft of substantially 25.7 millimeters, a second golf club grip having a second grip diameter measured prior to installation on a golf club shaft of substantially 26.7 millimeters, a third golf club grip having a third grip diameter measured prior to installation on a golf club shaft of substantially 27.7 millimeters, and a fourth golf club grip having a fourth grip diameter measured prior to installation on a golf club shaft of substantially 28.7 millimeters.

4. The golf club grip system of claim 1, wherein each of said plurality of golf club grips has a degree of torsion of at least five degrees and no more than twenty degrees.

5. The golf club grip system of claim 1, wherein each of said plurality of golf club grips includes an inner layer having an inner layer thickness and an outer wrap having an outer wrap thickness, both of said inner layer thickness and said outer wrap thickness measured at a distance of about 158 millimeters from a proximal end of each of said plurality of golf club grips defined by said cap end of each of said plurality of golf club grips, the sum of said inner layer thickness and said outer wrap thickness defining said grip wall thickness, wherein said inner layer thickness is at least 2.3 times greater than said outer wrap thickness and said inner layer thickness is no more than 3.1 times greater than said outer wrap thickness.

6. The golf club grip system of claim 5, wherein said inner layer thickness of each of said plurality of golf club grips is at least 2.7 times greater than said outer wrap thickness of each of said plurality of golf club grips.

7. The golf club grip system of claim 5, wherein said grip wall thickness of each of said plurality of golf club grips is no less than 1.30 times greater than said inner layer thickness of each of said plurality of golf club grips and said grip wall thickness of each of said plurality of golf club grips is no more than 1.45 times greater than said inner layer thickness of each of said plurality of golf club grips.

8. The golf club grip system of claim 5, wherein said outer wrap thickness of each of said plurality of golf club grips is at least 1.5 millimeters and no more than 2.1 millimeters.

9. A golf club grip system, comprising: a plurality of golf club grips, each of the plurality of golf club grips comprising: an inner layer forming a substantially cylindrical body having an open end for receipt of a golf club shaft and a cap end, said inner layer having an inner layer thickness measured prior to installation on a golf club shaft; and an outer wrap surrounding at least a portion of said inner layer and defining a gripping surface, said outer wrap having an outer wrap thickness measured prior to installation on a golf club shaft, said outer wrap including a first polymer layer secured to a first side of a felt layer, a first adhesive positioned on a second side of said felt layer, and a second polymer layer secured to said second side of said felt layer by said adhesive, wherein said inner layer thickness is at least 2.3 times greater than said outer wrap thickness and no more than 3.1 times greater than said outer wrap thickness when measured at a distance of about 158 millimeters from a proximal end of each of said plurality of golf club grips defined by said cap end of each of said plurality of golf club grips; wherein each of said plurality of golf club grips has an elastic deformation under five pounds of vertical compressive force of at least 1.0 millimeter and no more than 2.0 millimeters and an elastic deformation under fifteen pounds of vertical compressive force of at least 1.5 millimeters and no more than 3.0 millimeters.

10. The golf club grip system of claim 9, wherein said outer wrap of each of said plurality of golf club grips further comprises a second adhesive, wherein said outer wrap is secured to said inner layer by said second adhesive.

11. The golf club grip system of claim 9, wherein said inner layer thickness of each of said plurality of golf club grips is at least 2.7 times greater than said outer wrap thickness of each of said plurality of golf club grips when measured at a distance of about 158 millimeters from a proximal end of each of said plurality of golf club grips defined by said cap end of each of said plurality of golf club grips.

12. The golf club grip system of claim 11, wherein each of said plurality of golf club grips further comprise a grip wall thickness equal to a sum of said inner layer thickness and said outer wrap thickness, said grip wall thickness of each of said plurality of golf club grips being no more than 1.45 times greater than said inner layer thickness of each of said plurality of golf club grips and said grip wall thickness of each of said plurality of golf club grips being no less than 1.30 times greater than said inner layer thickness of each of said plurality of golf club grips when measured at a distance of about 158 millimeters from a proximal end of each of said plurality of golf club grips defined by said cap end of each of said plurality of golf club grips.

13. The golf club grip system of claim 9, wherein each of said plurality of golf club grips has a degree of torsion of at least five degrees and no more than twenty degrees.

14. The golf club grip system of claim 9, wherein said outer wrap thickness of each of said plurality of golf club grips is at least 1.5 millimeters and no more than 2.1 millimeters.

15. A golf club grip system, comprising:

a golf club grip having an inner layer and an outer wrap, said inner layer forming a substantially cylindrical body having an open end for receipt of a golf club shaft and a cap end, said outer wrap surrounding at least a portion of said inner layer and defining a gripping surface, said golf club grip having a grip diameter prior to installation on a golf club shaft defined by said gripping surface and a grip wall thickness extending radially from an inner surface of said inner layer to said gripping surface, both of said grip diameter and said grip wall thickness measured at a point about 158 millimeters from a proximal end of each of said plurality of golf club grips defined by said cap end of each of said plurality of golf club grips, said grip diameter being at least 25.4 millimeters and no more than 30.5 millimeters, wherein said golf club grip has a degree of torsion of at least 5 degrees and no more than 20 degrees, an elastic deformation under 5 pounds of vertical compressive force of at least 1.0 millimeters and no more than 2.0 millimeters, and an elastic deformation under 15 pounds of vertical compressive force of at least 1.5 millimeters and no more than 3.0 millimeters.

16. The golf club grip system of claim 15, wherein said golf club grip has a grip wall thickness of at least 5.6 millimeters and no more than 7.6 millimeters.

17. The golf club grip system of claim 15, further comprising a plurality of golf club grips, each of said plurality of golf club grips having a grip diameter of at least 25.4 millimeters and no more than 30.5 millimeters, a degree of torsion at least 5 degrees and no more than 20 degrees, an elastic deformation under 5 pounds of vertical compressive force of at least 1.0 millimeters and no more than 2.0 millimeters, and an elastic deformation under 15 pounds of vertical compressive force of at least 1.5 millimeters and no more than 3.0 millimeters.

18. The golf club grip system of claim 17, wherein said plurality of golf club grips includes a first golf club grip having a first grip diameter of substantially 25.7 millimeters measured prior to installation on a golf club shaft and at a point about 158 millimeters from a proximal end of said first golf club grip defined by said cap end of said first golf club grip, a second golf club grip having a second grip diameter of substantially 26.7 millimeters measured prior to installation on a golf club shaft and at a point about 158 millimeters from a proximal end of said second golf club grip defined by said cap end of said second golf club grip, a third golf club grip having a third grip diameter of substantially 27.7 millimeters measured prior to installation on a golf club shaft and at a point about 158 millimeters from a proximal end of said third golf club grip defined by said cap end of said third golf club grip, and a fourth golf club grip having a fourth grip diameter of substantially 28.7 millimeters measured prior to installation on a golf club shaft and at a point about 158 millimeters from a proximal end of said fourth golf club grip defined by said cap end of said fourth golf club grip.

* * * * *